US009925802B2

(12) United States Patent
Nishitani et al.

(10) Patent No.: US 9,925,802 B2
(45) Date of Patent: Mar. 27, 2018

(54) INK JET RECORDING APPARATUS

(71) Applicant: CANON KABUSHIKI KAISHA, Tokyo (JP)

(72) Inventors: Eisuke Nishitani, Tokyo (JP); Takao Ogata, Tokyo (JP); Akira Morita, Yokohama (JP); Takumi Otani, Kodaira (JP); Toshimori Miyakoshi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/432,184

(22) Filed: Feb. 14, 2017

(65) Prior Publication Data

US 2017/0232760 A1 Aug. 17, 2017

(30) Foreign Application Priority Data

Feb. 15, 2016 (JP) ..... 2016-026428

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002; B41J 2/01
See application file for complete search history.

(56) References Cited

U.S. PATENT DOCUMENTS

| | | | | |
|---|---|---|---|---|
| 3,962,153 | A | 6/1976 | Gore | |
| 7,517,045 | B2 | 4/2009 | Inoue | |
| 7,712,889 | B2 | 5/2010 | Inoue | |
| 9,067,449 | B2 | 6/2015 | Morita et al. | |
| 9,340,050 | B2 | 5/2016 | Otani et al. | |
| 9,527,314 | B2 | 12/2016 | Moriguchi et al. | |
| 2006/0232624 | A1* | 10/2006 | Inoue | B41J 3/44 347/23 |
| 2014/0192104 | A1 | 7/2014 | Toyama et al. | |
| 2016/0375680 | A1 | 12/2016 | Nishitani et al. | |
| 2017/0008273 | A1 | 1/2017 | Kuwabara et al. | |

FOREIGN PATENT DOCUMENTS

| | | | |
|---|---|---|---|
| JP | 56-45773 | B2 | 10/1981 |
| JP | 2006-306079 | A | 11/2006 |
| JP | 2009-045851 | A | 3/2009 |

* cited by examiner

*Primary Examiner* — Bradley Thies
(74) *Attorney, Agent, or Firm* — Fitzpatrick, Cella, Harper & Scinto

(57) ABSTRACT

Provided is a highly reliable ink jet recording apparatus capable of preventing the occurrence of image defects. The ink jet recording apparatus includes a liquid absorbing device including a porous body configured to absorb/remove an aqueous liquid component from an image containing the aqueous liquid component and a coloring material, a heat drying device configured to perform a heat drying treatment of the image after being subjected to the liquid absorption treatment, a temperature measuring device configured to measure the temperature of the image after being subjected to the heat drying treatment with the heat drying device, and a determination unit configured to determine the state of the liquid absorbing device from the measured temperature.

16 Claims, 9 Drawing Sheets

INK JET RECORDING APPARATUS

BACKGROUND OF THE INVENTION

Field of the Invention

The present invention relates to an ink jet recording apparatus.

Description of the Related Art

In an ink jet recording method, a liquid composition containing a coloring material (ink) is directly or indirectly applied onto a recording medium such as paper to form an image. During the process, the recording medium may excessively absorb a liquid component in the ink, thereby causing curing or cockling.

In order to immediately remove the liquid component in an ink to suppress such trouble, there are a method of drying a recording medium by using warm air, infrared light, or a similar technique and a method in which an image is formed on a transfer body, then a liquid component contained in the image on the transfer body is dried by thermal energy or the like, and the image is transferred to a recording medium such as paper.

Another method is disclosed as the technology of removing the liquid component contained in an image on a transfer body without using thermal energy. In the method, a roller-like porous body is brought into contact with an ink image to absorb and remove the liquid component from the ink image (Japanese Patent Application Laid-Open No. 2009-45851).

Another method is disclosed as the technology for removing water from an image formed by an ink on a recording medium. In the method, liquid removal conditions are optimized when a liquid removal roller is used (Japanese Patent Application Laid-Open No. 2006-306079). In Japanese Patent Application Laid-Open No. 2006-306079, the water content on the surface of a roller for liquid removal from images on a recording medium is measured by a moisture sensor, and liquid suction conditions of the liquid roller or contact conditions of the liquid roller with images are changed on the basis of the measurement result to optimize the liquid removal conditions.

The measurement of the water content of an object to be measured by a moisture sensor is, however, performed by bringing the moisture sensor into contact with the object to be measured. When such a contact-type sensor for measuring a water content is repeatedly brought into contact with the surface layer of a roller for liquid removal, the surface layer of the roller may be scratched, and this may reduce the liquid removal efficiency from images to cause image defects.

SUMMARY OF THE INVENTION

The present invention is directed to providing a more reliable ink jet recording apparatus that prevents the occurrence of image defects associated with the workings of a liquid absorbing device that absorbs a liquid component from images formed on an ink receiving medium.

An ink jet recording apparatus according to the present invention includes an image forming unit configured to form a first image containing an aqueous liquid component and a coloring material on an ink receiving medium, a liquid absorbing device including a porous body having a first surface configured to come into contact with the first image, the porous body being configured to absorb at least a part of the aqueous liquid component from the first image to form a second image, a heat drying device configured to perform a heat drying treatment of the second image, a first temperature measuring unit configured to measure a temperature $T_{_After}$ of the second image after being subjected to the heat drying treatment, and a determination unit configured to determine a state of the liquid absorbing device from the temperature $T_{_After}$.

Further features of the present invention will become apparent from the following description of exemplary embodiments with reference to the attached drawings.

DESCRIPTION OF THE EMBODIMENTS

Figure 1:
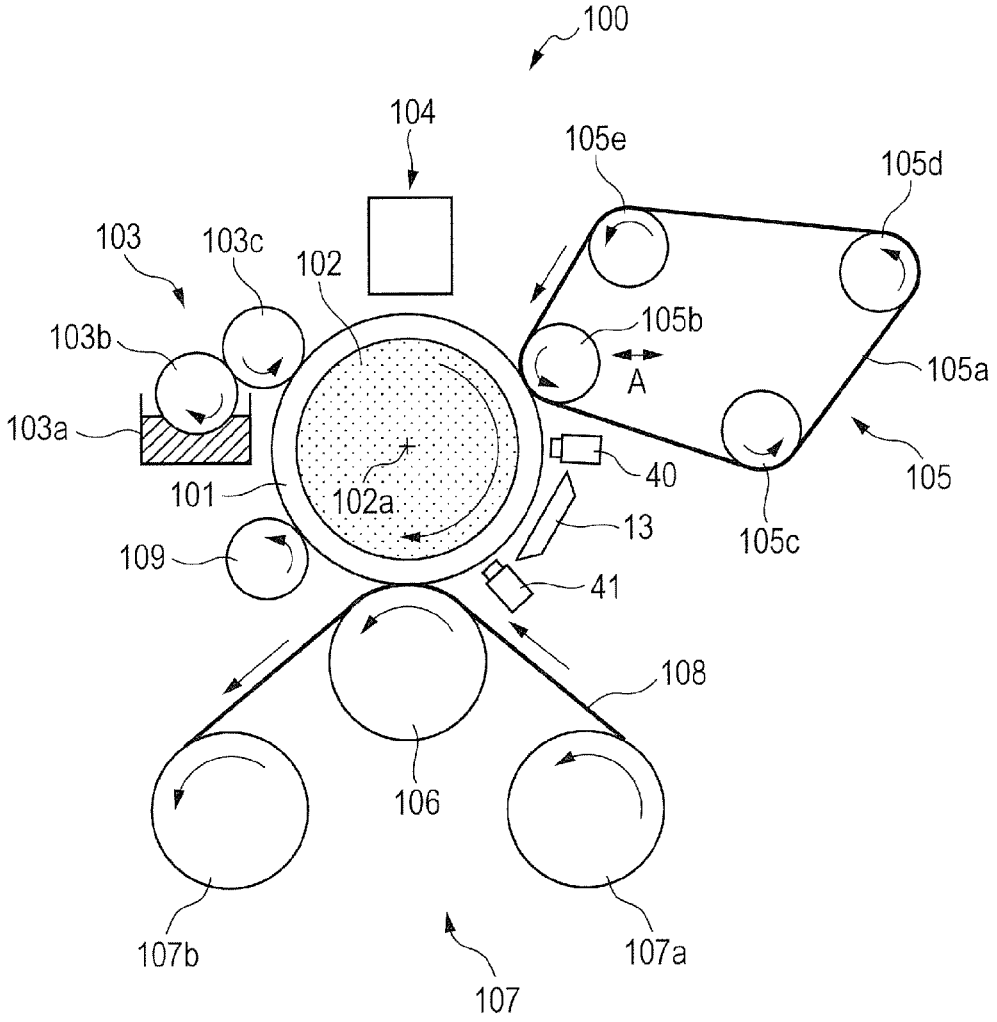
FIG. 1 is a schematic view showing an exemplary structure of a transfer type ink jet recording apparatus in the present invention.

Preferred embodiments of the present invention will now be described in detail in accordance with the accompanying drawings.

An ink jet recording apparatus of the present embodiment includes an image forming unit, a liquid absorbing device, and a heat drying device. The image forming unit includes an ink jet recording unit that applies an ink containing an aqueous liquid medium, a resin, and a coloring material to an ink receiving medium, and forms a first image containing an aqueous liquid component, the resin, and the coloring material on the ink receiving medium. The aqueous liquid component contained in the first image is a liquid component containing at least water, and the aqueous liquid component contains the aqueous liquid medium that is applied as a component of the ink to the ink receiving medium.

The image forming unit can include a liquid applying unit that applies a liquid for improving the fixability of a first image to an ink receiving medium, as needed. By forming a first image from an ink and a fixability improving liquid from the liquid applying unit, the fixability of the first image onto an ink receiving medium can be improved. The first image prepared from an ink and a fixability improving liquid contains an aqueous liquid component obtained by mixing the fixability improving liquid and the ink.

As the ink, an aqueous ink containing an aqueous liquid medium, a resin, and a coloring material is used. The resin is added to an ink for improving image qualities, the fixability to an ink receiving medium, and the toughness and abrasion resistance of images.

The liquid absorbing device includes a liquid absorbing member including a porous body. The porous body has a first surface to come into contact with a first image and absorbs at least a part of an aqueous liquid component from the first image to form a second image. The liquid absorbing device performs a contact type liquid absorption treatment.

The heat drying device is a device that heats and dries the second image prepared by treatment of a first image with the liquid absorbing device. By holding the second image in a region heated by the heat drying device for an intended time, the heat drying treatment of the second image is performed.

The first image is an ink image before being subjected to the liquid removal in the liquid absorption treatment by a liquid absorbing member. The second image is an ink image after being subjected to the liquid removal by the liquid absorption treatment to reduce the content of the first liquid.

The ink jet recording apparatus of the present embodiment includes a determination unit to check the operating state (working state) of the liquid absorbing device. The determination unit can determine whether the liquid absorbing device works properly or malfunctions. The determination of the working state of the liquid absorbing device by the determination unit can be performed by executing a determination process including the following steps by using the temperature $T_{_After}$ of a second image treated with the heat drying device as a determination index.

(A) The temperature range of a second image after being subjected to the heat drying treatment when the liquid absorbing device works properly is previously set as a standard temperature range, or a threshold $T_{_After}$-th range for determination.

(B) The temperature $T_{_After}$ of a second image is compared with the threshold $T_{_After}$-th range for determination.

(C) When the temperature $T_{_After}$ of a second image is within the threshold $T_{_After}$-th range, it is determined that the liquid absorbing device works properly, whereas when the temperature $T_{_After}$ of a second image is out of the threshold $T_{_After}$-th range, it is determined that the liquid absorbing device malfunctions.

For the above determination, a temperature measuring device including a first temperature measuring unit for measuring the temperature $T_{_After}$ of a second image is provided in the ink jet recording apparatus, and the determination unit determines whether the liquid absorbing device works properly or malfunctions.

The determination unit can be provided in the ink jet recording apparatus or outside the ink jet recording apparatus to which the determination unit can be connected as needed.

A subject image for the determination of the working state of the liquid absorbing device is exemplified by an actual image (an image used for an intended purpose), a test pattern used before the formation of an actual image or used when an apparatus is interrupted, and a test pattern formed in a margin or the like of an actual image not affecting the actual image.

The method of setting a threshold $T_{_After}$-th range may be any threshold setting method usable for the determination of the workings of an intended liquid absorbing device. For example, the following threshold setting method can be used.

(A) When a whole ink jet recording apparatus works properly, a temperature increase width in the heat drying treatment of second images on an ink receiving medium due to changes of the ink discharging amount for forming first images is recorded. From the obtained data, a "list of ink discharging amounts and temperature increases" is prepared.

(B) When an image actually used (actual image) is subjected to determination, the ink discharging amount data used for forming the actual image in a temperature measurement region is compared with the ink discharging amounts in the "list of ink discharging amounts and temperature increases". From the ink discharging amount of the actual image, the temperature increase range in the temperature increase list is set as the threshold when the apparatus works properly.

(C) When a test pattern for determination is subjected to determination, an ink discharging amount selected from the "list of ink discharging amounts and temperature increases" is used to form the test pattern for determination. The temperature increase range corresponding to the selected ink discharging amount is set as the threshold.

In place of the ink discharging amount for forming a first image, the content of a liquid component in a first image can be used to prepare a "list of image liquid amounts and temperature increases", and the above threshold can be set. The liquid amount in a first image can be estimated from the ink discharging amount for forming the first image. When a liquid for accelerating fixation of an image is used, the liquid amount in a first image can also be estimated from the amount of the liquid and the ink discharging amount. Alternatively, for a first image for a test pattern, the amount of liquid contained in the first image can be determined by the following procedure. An image for measuring the liquid amount is separately prepared, then the image for measuring the liquid amount is dried to give a weight change, and the liquid amount is calculated from the weight change.

The above method of setting a threshold can be similarly applied to the setting of the thresholds mentioned below.

To further improve the determination reliability of the working state of a liquid absorbing device, a determination process further including the determination of the temperature $T_{_Before}$ of a second image before being subjected to the heat drying treatment can be used. The determination process can be performed by executing a determination process including the following steps in the determination unit.

(I) The temperature difference range before and after being subjected to the heat drying treatment of a second image when a liquid absorbing device works properly is previously set as a standard temperature difference range, or a threshold ΔT-th range for determination.

(II) The temperature $T_{_Before}$ of a second image before being subjected to the heat drying treatment and the temperature $T_{_After}$ of the second image after being subjected to the heat drying treatment are measured, and the difference thereof ($\Delta T$: $T_{_After} - T_{_Before}$) is calculated.

(III) ΔT is compared with the threshold ΔT-th range for determination.

(IV) When ΔT is within the threshold ΔT-th range for determination, it is determined that the liquid absorbing device works properly, whereas when ΔT is out of the threshold ΔT-th range for determination, it is determined that the liquid absorbing device malfunctions.

The temperature $T_{_Before}$ of a second image can be measured by providing, in the temperature measuring device, a second temperature measuring unit for measuring a temperature $T_{_Before}$.

The ink jet recording apparatus can include a mode enabling the selection of a handling method when the determination unit determines that the liquid absorbing device malfunctions (fails to work properly).

The handling method is exemplified by the following methods.

(a) The liquid absorbing device is subjected to maintenance.

(b) The control unit of the liquid absorbing device directs the liquid absorbing device to change running conditions of the liquid absorbing device.

The maintenance of a liquid absorbing device can be performed by a method depending on a supposed cause of the malfunction of the liquid absorbing device. The malfunction of a liquid absorbing device is exemplified by a reduction of the liquid absorbability caused by, for example, an increase of the amount of a liquid absorbed by the porous body of a liquid absorbing member, an increase in viscosity of the liquid, or the adhesion of foreign substances to the porous body surface. For such a case, a maintenance device for performing a method in which image formation is interrupted, then pure water is pushed into a porous body by a pressure roller, and the liquid having a higher viscosity in the porous body is removed by air pressure, a method of removing foreign substances from the porous body surface by an adhesive roller, or a similar method is provided.

The running conditions to be changed in order to solve the malfunction of a liquid absorbing device can be selected from the pressure of a porous body against an ink receiving medium, the contact time of a porous body with an ink receiving medium, and application conditions of a wetting liquid when the wetting liquid is used, for example.

The timing of checking the working state of a liquid absorbing device may be any timing when intended normal workings can be maintained. The working state of a liquid absorbing device can be checked once after a certain number of images have been formed or after a job relating to image formation has been input into an apparatus. For example, at the time when the formation of a predetermined number of actual images is completed or when the actual image formation based on an input job is completed, the operation of actual image formation can be interrupted, and a test pattern for determination can be formed to check the workings of the liquid absorbing device. Alternatively, a test pattern is formed in an area not affecting an actual image, such as a header area of the actual image, to check the operating state of a liquid absorbing device without interruption of the operation of actual image formation.

For a test pattern for determination formed on an ink receiving medium or an unnecessary image including an image formed on an ink receiving medium at the time of the malfunction of a liquid absorbing device, a disposal system for disposing such an image can be provided. When the ink receiving medium is a paper sheet, a disposal system of disposing such an unnecessary image via another conveyance path can be used. When the ink receiving medium is a roll paper, a disposal system in which an unnecessary image portion is selected at the time of cutting and is disposed via another conveyance path can be used.

An error message output unit for outputting an error message of device workings can be provided to inform the necessity of mode selection for executing a handling method when it is determined that a liquid absorbing device malfunctions.

The way of outputting an error message can be selected from various ways. For example, the message can be output as lighting or blinking of a luminous body such as a lamp and a display for characters and the like, body-sensible vibration, or audible sound or melody.

The handling method (a) or (b) can be performed by a control unit that controls a liquid absorbing device based on a determination result of the working state of the liquid absorbing device. One of the handling methods (a) and (b) can be performed in response to automatic selection by a previously set program or can be performed in response to manual selection by a user.

One of the handling methods (a) and (b) can be selected on the basis of the relation between a malfunction manner or a malfunction degree of the liquid absorbing device and an actual measured value out of the threshold range caused by the malfunction.

In addition to the determination of the working state of a liquid absorbing device, checking of the working state of a heat drying device enables the ink jet recording apparatus to have higher reliability. The working state of a heat drying device can be checked by executing a process including the following steps.

(i) The temperature $T_P_{_After}$ of a non-image formation area in the region with a second image on an ink receiving medium after the heat drying treatment is measured.

(ii) From the temperature $T_P_{_After}$, it is determined whether the heat drying device works properly or malfunctions. The temperature $T_P_{_After}$ can be measured by providing, in the temperature measuring device, a third temperature measuring unit for measuring a temperature $T_P_{_After}$.

The above determination (ii) can be performed by executing a process including the following steps in the determination unit.

(ii-1) The temperature range of a non-image formation area in the region with a second image on an ink receiving medium after being subjected to the heat drying treatment when a heat drying device works properly is previously set as a standard temperature range, or a threshold $T_P_{_After}$-th range for determination.

(ii-2) A temperature $T_P_{_After}$ is compared with the threshold $T_P_{_After}$-th range for determination.

(ii-3) When a temperature $T_P_{_After}$ is within the previously set $T_P_{_After}$-th range, it is determined that the heat drying device works properly, whereas when a temperature $T_P_{_After}$ is out of the previously set $T_P_{_After}$-th range, it is determined that the heat drying device malfunctions.

The ink jet recording apparatus may include a configuration enabling selection of ON/OFF mode for executing a check function of the working state of a heat drying device. This enables mode selection for checking a heat drying device when checking of the working state of the heat drying device is needed.

The timing of checking the working state of a heat drying device may be any timing when the checking is required to maintain intended normal workings of the device. The checking can be performed concurrently with the above-mentioned checking of the working state of a liquid absorbing device or can be performed once after a predetermined number of times of checking of the working state of a liquid absorbing device.

To further improve the determination reliability of the working state of the ink jet recording apparatus, a determination process further including the determination of the temperature $T_R_{_Before}$ of a non-image formation area in the region with a second image on an ink receiving medium before being subjected to the heat drying treatment can be used. The determination process can be performed by executing a determination process including the following steps in the determination unit.

(1) The temperature difference range before and after being subjected to the heat drying treatment of a non-image formation area in the region with a second image on an ink receiving medium when a heat drying device works properly is previously set as a standard temperature difference range, or a threshold ΔT_R-th range for determination.

(2) The temperature $T_P_{_Before}$ of a non-image formation area in the region with a second image on an ink receiving medium before being subjected to the heat drying treatment is measured.

(3) The difference between the temperature $T_P_{_Before}$ and the $T_P_{_After}$ before and after being subjected to the heat drying treatment (ΔT_P: $T_P_{_After}-T_P_{_Before}$) is calculated.

(4) ΔT_P is compared with ΔT_R-th.

(5) When ΔT_P ($T_P_{_After}-T_P_{_Before}$) is within the previously set ΔT_P-th range, it is determined that the heat drying device works properly, whereas when ΔT_P is out of the previously set ΔT_P-th range, it is determined that the heat drying device malfunctions.

The temperature $T_P_{_Before}$ can be measured by providing, in the temperature measuring device, a fourth temperature measuring unit for measuring $T_P_{_Before}$.

The handling method when the determination unit determines that the heat drying device malfunctions is exemplified by the following methods.

(c) The heat drying device is subjected to maintenance.

(d) The control unit of the heat drying device directs the heat drying device to change running conditions of the heat drying device.

The maintenance of a heat drying device can be performed by a method depending on a supposed cause of the malfunction of the heat drying device. For example, when an infrared heating is used as the heat drying device, a detection device for checking dust on a reflector and/or a glass tube for emitting infrared light and a cleaning device for wiping such dust are provided.

The running conditions of a heat drying device to be changed include the output of the heat drying device, the positional relation between a heating unit of the heat drying device and an ink receiving medium (the distance therebetween for a noncontact type), and the retention time of a region to be heated on an ink receiving medium in the heat treatment region.

An error message output unit for outputting an error message of device workings can also be provided to inform the necessity of mode selection for executing a handling method when it is determined that the heat drying device malfunctions.

The handling method (c) or (d) can be performed by a control unit that controls a heat drying device in response to a determination result of the working state of the heat drying device. One of the handling methods (c) and (d) can be performed in response to automatic selection by a previously set program or can be performed in response to manual selection by a user.

One of the handling methods (c) and (d) can be selected on the basis of the relation between a malfunction manner or a malfunction degree of a heat drying device and an actual measured value out of the threshold range caused by the malfunction.

The first temperature measuring unit and the third temperature measuring unit, which are provided in the temperature measuring device, may be independently provided or may be common as the same temperature measuring unit. Similarly, the second temperature measuring unit and the fourth temperature measuring unit, which are provided in the temperature measuring device, may be independently provided or may be common as the same temperature measuring unit.

In addition, checking of the working state of an image forming unit by using the determination of the working state of a liquid absorbing device enables the ink jet recording apparatus to have higher reliability. The working state of an image forming unit can be checked by enabling selection of a mode for executing a process including the following steps.

(e) When the determination unit determines that the liquid absorbing device malfunctions, maintenance of the image forming unit or checking of the ink applying state from the ink jet recording unit to the ink receiving medium is directed.

The maintenance of an image forming unit can be performed by a method depending on a supposed cause of the malfunction of the heat drying device. For example, against discharge defect by clogging of a discharge orifice on an ink jet recording head, the maintenance of the ink jet recording unit is performed by a discharge recovery device provided in the liquid applying unit, for example, by a recovery operation of the discharge orifice with a suction unit.

The ink applying state from an ink jet recording unit to an ink receiving medium can be checked by the following procedure. Single dots are printed at constant intervals on a transfer body, then the printed dots are read by a print reader such as a line sensor, and success or failure of discharging is determined. When a deviation of the discharge direction of an ink or a discharge failure is detected in the checking of the ink applying state, the above maintenance is performed.

The handling method (e) can be performed by a control unit that controls an image forming unit in response to a determination result of the working state of the image forming unit. The handling method (e) can be performed in response to automatic selection by a previously set program or can be performed in response to manual selection by a user.

As described above, in addition to the checking of the working state of a liquid absorbing device, the checking of the working state of a heat drying device and/or an image forming unit can be added. The timing of performing the additional steps for checking the working state may be any timing when the checking is required to maintain intended normal workings of the device. For example, the checking can be performed concurrently with the checking of the working state of a liquid absorbing device or can be performed once after a predetermined number of times of checking of the working state of a liquid absorbing device. Alternatively, the additional checking of the working state can be performed before or after the checking of the working state of a liquid absorbing device.

The working state of a heat drying device and/or an image forming unit can be checked concurrently with or separately from the above-mentioned checking of the working state of a liquid absorbing device, for example.

According to the present invention, by bringing a porous body of the liquid absorbing member into contact with a first image containing an aqueous liquid component, a resin, and a coloring material on an ink receiving medium, at least a part of the aqueous liquid component is removed from the first image. This prevents a recording medium such as paper from excessively absorbing the aqueous liquid component in the first image, thereby suppressing curing or cockling.

The image forming unit includes a device constituting an ink jet recording unit configured to apply an ink containing an aqueous liquid component, a resin, and a coloring material onto the ink receiving medium. The device constituting the ink jet recording unit may be any device that enables the formation of a first image containing an aqueous liquid component, a resin, and a coloring material on an ink receiving medium.

As the liquid for improving the fixability of an image, the reaction liquid described later can be used. When the reaction liquid and the ink are used in combination, the image forming unit preferably further includes a liquid applying unit configured to apply the reaction liquid to the ink receiving medium.

The first image can be formed by applying the reaction liquid and the ink to the ink receiving medium in such a manner as to give a region in which the reaction liquid at least overlaps with the ink. The reaction liquid accelerates and improves the fixability of a coloring material applied together with the ink onto the ink receiving medium. The acceleration and improvement in fixability of a coloring material means that an ink turns from the initial state in which the ink applied to an ink receiving medium has flowability into the state in which the flowability of the ink itself or of a coloring material in the ink is lowered by the action of a reaction liquid, thus the viscosity is increased, and the ink is unlikely to flow and is immobilized as compared with the initial state. The mechanism will be described later. The ink contains an aqueous liquid medium containing water, and the reaction liquid also contains an aqueous liquid medium containing water as needed. The first image contains an aqueous liquid component containing water derived from these aqueous liquid media together with the resin and the coloring material.

As the device of applying the ink onto an ink receiving medium, an ink jet recording device is used.

The reaction liquid can contain a component that chemically or physically interacts with an ink to viscously thicken a mixture of the reaction liquid and the ink as compared with each of the reaction liquid and the ink and improves the fixability of a coloring material. The reaction liquid can contain an aqueous liquid medium. The aqueous liquid medium contains at least water and may contain a water-soluble organic solvent or various additives, as needed.

At least one of the reaction liquid and the ink can contain a second liquid in addition to water as a first liquid. The second liquid may have any volatility, but is preferably a liquid having a higher volatility than that of the first liquid.

An embodiment of the present invention will next be described. In the following description, a "reaction liquid applying device" is used as the reaction liquid applying unit, and an "ink applying device" is used as the ink jet recording unit.

<Reaction Liquid Applying Device>

The reaction liquid applying device may be any device capable of applying a reaction liquid onto an ink receiving medium, and conventionally known various devices can be appropriately used. Specific examples of the device include a gravure offset roller, an ink jet head, a die coating device (die coater), and a blade coating device (blade coater). The application of a reaction liquid by the reaction liquid applying device may be performed either before the application of an ink or after the application of an ink as long as the reaction liquid can be mixed (reacted) with an ink on an ink receiving medium. Preferably, the reaction liquid is applied before the application of an ink. The application of a reaction liquid before the application of an ink enables suppression of bleeding, which is caused by mixing of inks applied adjacent to each other, or beading, which is caused by pulling of a previously applied ink by a subsequently applied ink at the time of image recording by the ink jet system.

<Reaction Liquid>

The reaction liquid contains a component that increases the viscosity of an ink (ink-viscosity-increasing component). Here, the increase in viscosity of an ink is such a phenomenon that when a coloring material, a resin, or the like as a component constituting an ink comes into contact with an ink-viscosity-increasing component, the components are chemically reacted or physically adsorbed, and this causes an increase in viscosity of the ink. The increase in viscosity of an ink includes not only an increase in viscosity of an ink but also a local increase in viscosity by aggregation of some of the components constituting an ink, such as a coloring material and a resin.

The ink-viscosity-increasing component has the effect of lowering the flowability of an ink and/or some of the components constituting an ink on an ink receiving medium to suppress bleeding or beading at the time of first image formation. In the present invention, increasing the viscosity of an ink is also called "viscously thickening an ink". As such an ink-viscosity-increasing component, polyvalent metal ions, organic acids, cation polymers, porous microparticles, and other known materials can be used. Specifically preferred are polyvalent metal ions and organic acids. A plurality of types of ink-viscosity-increasing components can also be preferably contained. The content of the ink-viscosity-increasing component in the reaction liquid is preferably 5% by mass or more relative to the total mass of the reaction liquid.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$, and $Zn^{2+}$; and trivalent metal ions such as $Fe^{3+}$, $Cr^{3+}$, $Y^{3+}$, and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

The reaction liquid can contain water or a low volatile organic solvent in an appropriate amount as the aqueous liquid medium. The water used in this case is preferably a deionized water prepared by ion exchanging, for example. The organic solvent usable in the reaction liquid to be applied to the present invention is not limited to particular solvents, and a known organic solvent can be used.

To the reaction liquid, a surfactant or a viscosity modifier can be added to appropriately adjust the surface tension or the viscosity thereof, and such a reaction liquid can be used. The material to be used may be any material that can coexist with the ink-viscosity-increasing component. The surfactant specifically used is exemplified by an acetylene glycol ethylene oxide adduct ("Acetylenol E100" (trade name), manufactured by Kawaken Fine Chemicals), fluorochemical surfactants including a perfluoroalkyl ethylene oxide adduct (such as "MEGAFACE F444" (trade name) manufactured by DIC Corporation; "Capstone FS-3100" (trade name) manufactured by The Chemours Company, LLC; and Zonyl FS3100 (trade name) manufactured by DuPont), and silicone surfactants including a polyether modified polydimethylsiloxane adduct ("BYK349" (trade name) manufactured by BYK).

<Ink Applying Device>

As the ink applying device for applying an ink, an ink jet head is used. The ink jet head is exemplified by a device that causes film boiling of an ink by an electrothermal converter to form bubbles and discharges the ink, a device that discharges an ink by an electromechanical converter, and a device that discharges an ink by using static electricity. In the present invention, a known ink jet head can be used. Of them, the device using an electrothermal converter can be suitably used, particularly from the viewpoint of high-density printing at high speed. To record an image, the head applies an intended amount of an ink to an intended position upon receiving an image signal.

The ink application amount can be expressed by image density (duty) or ink thickness. In the present invention, the mass of each ink dot is multiplied by the number of dots applied (the number of dots discharged), and the result is divided by a printed area to give an average as the ink application amount ($g/m^2$). The maximum ink application amount in an image region represents an ink application amount in an area of at least 5 $mm^2$ or more within a region used as information of an ink receiving medium from the viewpoint of removing the liquid component in an ink.

The ink jet recording apparatus of the present invention can include a plurality of ink jet heads in order to apply various color inks on an ink receiving medium. For example, when a yellow ink, a magenta ink, a cyan ink, and a black ink are used to form a four-color image, the ink jet recording apparatus includes four ink jet heads that each discharges a corresponding ink of the four inks on an ink receiving medium.

The ink applying device may further includes an ink jet head that discharges an ink containing no coloring material (clear ink).

<Ink>

The ink applied to the present invention contains an aqueous liquid medium, a resin, and a coloring material. Each component of the ink will next be described.

(Coloring Material)

As the coloring material contained in the ink applied to the present invention, a pigment or a mixture of a dye and a pigment can be used. The pigment usable as the coloring material is not limited to particular types. Specific examples of the pigment include inorganic pigments such as carbon black; and organic pigments such as azo pigments, phthalocyanine pigments, quinacridone pigments, isoindolinone pigments, imidazolone pigments, diketopyrrolopyrrole pigments, and dioxazine pigments. These pigments can be used singly or in combination of two or more of them as needed.

The dye usable as the coloring material is not limited to particular types. Specific examples of the dye include direct dyes, acid dyes, basic dyes, disperse dyes, and food dyes, and a dye having an anionic group can be used. Specific examples of the dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5% by mass or more to 15.0% by mass or less and more preferably 1.0% by mass or more to 10.0% by mass or less relative to the total mass of the ink.

(Dispersant)

As the dispersant for dispersing a pigment, a known dispersant used in an ink jet ink can be used. Specifically, a water-soluble dispersant having both a hydrophilic moiety and a water-repellent moiety in the structure is preferably used in an embodiment of the present invention. In particular, a pigment dispersant composed of a resin prepared by copolymerizing a mixture containing at least a hydrophilic monomer and a water-repellent monomer is preferably used. Each monomer used here is not limited to particular monomers, and known monomers are suitably used. Specifically, examples of the water-repellent monomer include styrene and other styrene derivatives, alkyl (meth)acrylates, and benzyl (meth)acrylate. Examples of the hydrophilic monomer include acrylic acid, methacrylic acid, and maleic acid.

The dispersant preferably has an acid value of 50 mg KOH/g or more to 550 mg KOH/g or less. The dispersant preferably has a weight average molecular weight of 1,000 or more to 50,000 or less. The mass ratio of the pigment and the dispersant (pigment:dispersant) is preferably in a range of 1:0.1 to 1:3.

What is called a self-dispersible pigment that is dispersible due to surface modification of a pigment itself and eliminates the use of the dispersant is also preferably used in the present invention.

(Resin Component)

The resin component for the ink is added to the ink in order to improve image qualities, the fixability to an ink receiving medium, and the toughness or abrasion resistance of images. The resin used as the resin component may be any resin that can achieve such a purpose, and can be selected from commercially available resins or resins known to be used for such a purpose. As the resin component, various resin particles containing no coloring material can be preferably used. Of them, resin microparticles, which may have an effect of improving image qualities or fixability, are preferred. As the resin particles, resin microparticles having film formability by heating under an intended pressure are preferred in terms of increasing the content of a resin component in an ink and of further improving the effect by using the resin component.

The material of the resin microparticles usable in the present invention is not limited to particular materials, and known resins can be appropriately used. The material is specifically exemplified by homopolymers such as polyolefin, polystyrene, polyurethane, polyester, polyether, polyurea, polyamide, polyvinyl alcohol, poly(meth)acrylic acid and salts thereof, polyalkyl (meth)acrylate, and polydiene; and copolymers prepared by copolymerizing a plurality of monomers, which are used for forming such a homopolymer, in combination. The resin preferably has a weight average molecular weight (Mw) of 1,000 or more to 2,000,000 or less. In the ink, the content of the resin microparticles is preferably 1% by mass or more to 50% by mass or less and more preferably 2% by mass or more to 40% by mass or less relative to the total mass of the ink.

In an embodiment of the present invention, the resin microparticles are preferably used as a resin microparticle dispersion in which the resin microparticles are dispersed in a liquid. The dispersion technique is not limited to particular techniques. Preferred is what is called a self-dispersion type resin microparticle dispersion in which a resin prepared by homopolymerization of a monomer having a dissociable group or by copolymerization of a plurality of such monomers is dispersed. The dissociable group is exemplified by a carboxyl group, a sulfonic acid group, and a phosphoric acid group, and the monomer having such a dissociable group is exemplified by acrylic acid and methacrylic acid. In addition, what is called an emulsion-dispersion type resin microparticle dispersion in which resin microparticles are dispersed with an emulsifier can be similarly, suitably used in the present invention. As the emulsifier as used herein, a known surfactant is preferred regardless of having a low molecular weight or a high molecular weight. The surfactant is preferably a nonionic surfactant or a surfactant having the same charge as that of resin microparticles.

The resin microparticle dispersion used in an embodiment of the present invention preferably has a dispersion particle diameter of 10 nm or more to 1,000 nm or less and more preferably 100 nm or more to 500 nm or less.

When the resin microparticle dispersion used in an embodiment of the present invention is prepared, various additives are preferably added for stabilization. Examples of the additive include n-hexadecane, dodecyl methacrylate, stearyl methacrylate, chlorobenzene, dodecyl mercaptan, a blue dye (bluing agent), and polymethyl methacrylate.

(Surfactant)

The ink usable in the present invention may contain a surfactant. The surfactant is specifically exemplified by an acetylene glycol ethylene oxide adduct (Acetylenol E100 (trade name), manufactured by Kawaken Fine Chemicals). In the ink, the content of the surfactant is preferably 0.01% by mass or more to 5.0% by mass or less relative to the total mass of the ink.

As described in the section of reaction liquid, the ink and/or the reaction liquid can be formulated so that an aqueous liquid component produced by reacting the ink with the reaction liquid will have a contact angle of less than 90° with respect to the first surface of a porous body. The contact angle of the mixture can be adjusted by selecting the type or the amount of a surfactant added to the ink and/or the reaction liquid.

(Water and Water-Soluble Organic Solvent)

The aqueous liquid medium in the ink is a liquid medium containing at least water. As the ink containing an aqueous liquid medium, or as the aqueous ink, an aqueous pigment ink containing at least a pigment as the coloring material can be used.

The aqueous liquid medium can further contain a water-soluble organic solvent as needed. The water is preferably a deionized water prepared by ion exchanging, for example. In the ink, the content of the water is preferably 30% by mass or more to 97% by mass or less relative to the total mass of the ink, and is more preferably 50% by mass or more to 95% by mass or less relative to the total mass of the ink.

The type of the water-soluble organic solvent to be used is not limited to particular types, and any known organic solvent can be used. Specific examples of the water-soluble organic solvent include glycerol, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Needless to say, two or more solvents selected from these solvents can be used as a mixture.

In the ink, the content of the water-soluble organic solvent is preferably 3% by mass or more to 70% by mass or less relative to the total mass of the ink.

(Other Additives)

The ink usable in the present invention may contain, in addition to the above components, various additives such as a pH adjuster, an anticorrosive, an antiseptic agent, an antifungal agent, an antioxidant, a reduction inhibitor, a water-soluble resin and a neutralizer thereof, and a viscosity modifier, as needed.

<Liquid Absorbing Member>

In the present invention, at least a part of the aqueous liquid component is absorbed from a first image by bringing the liquid absorbing member including a porous body into contact, and thus the amount of the liquid (the content of the liquid component) in the first image is reduced. The contact surface of the liquid absorbing member with the first image is regarded as a first surface, and the porous body is placed on the first surface.

(Porous Body)

In order to suppress adhesion of the coloring material in an ink, the porous body preferably has a small pore diameter, and at least the porous body on the side that comes into contact with an image preferably has a pore diameter of 10 μm or less. In the present invention, the pore diameter means an average diameter, and can be determined by a known technique such as a mercury intrusion method, a nitrogen adsorption method, and SEM image observation.

In order to evenly achieve high breathability, the porous body preferably has a small thickness. The breathability can be expressed as Gurley value in accordance with JIS P8117, and the Gurley value is preferably 10 seconds or less. The shape of the porous body is not limited to particular shapes, but is exemplified by a roller shape and a belt shape.

A thin porous body, however, cannot ensure a capacity sufficient to absorb a liquid component in some cases, and thus the porous body can have a multilayer structure. In the liquid absorbing member, only the layer to come into contact with an image on the transfer body is required to be a porous body, and a layer not to come into contact with an image on the transfer body is not necessarily a porous body.

The production process of the porous body is not specifically limited, and a production process conventionally, widely used can be adopted. An example is disclosed in the specification of Japanese Patent No. 1114482 and is a production process of a porous body by biaxial stretching of a resin containing polytetrafluoroethylene.

In the present invention, the porous body may be made from any material, and any of the hydrophilic materials having a contact angle with pure water of less than 90° and the water-repellent materials having a contact angle with pure water of 90° or more can be used.

When used, the hydrophilic material preferably has a contact angle with water of 40° or less. When composed of a hydrophilic material, the first layer has the effect of sucking an aqueous liquid component by capillary force.

The hydrophilic material is exemplified by polyolefins (including polyethylene (PE)), polyurethanes, nylons, polyamides, polyesters (including polyethylene terephthalate (PET)), and polysulfone (PSF).

The porous body is preferably water repellent in order to reduce the affinity with the coloring material contained in a first image. The water-repellent porous body preferably has a contact angle with pure water of 90° or more. As a result of intensive studies by the inventors of the present invention, it has been revealed that when a porous body having a contact angle with pure water of 90° or more is used, the adhesion of an ink coloring material to the porous body can be suppressed. In the present specification, the contact angle is an angle between the surface of an object and the tangent line of a liquid drop at a position where the liquid drop is in contact with the object when a measurement liquid is dropped onto the object. Although the measurement technique includes some types, the inventors of the present invention measured the water repellency in accordance with the technique described in "6. Sessile drop method" in JIS R3257.

The water-repellent porous body may be made from any material that has a contact angle with pure water of 90° or more, but is preferably made from a water-repellent resin. The water-repellent resin is preferably a fluororesin. The fluororesin is specifically exemplified by polytetrafluoroethylene (hereinafter PTFE), polychlorotrifluoroethylene (PCTFE), polyvinylidene fluoride (PVDF), polyvinyl fluoride (PVF), perfluoroalkoxy fluororesin (PFA), a tetrafluoroethylene/hexafluoropropylene copolymer (FEP), an ethylene/tetrafluoroethylene copolymer (ETFE), and an ethylene/chlorotrifluoroethylene copolymer (ECTFE). These resins can be used singly or in combination of two or more of them as needed. A plurality of films may be laminated. Of them, polytetrafluoroethylene is preferred.

<Multilayer Structure>

Next, an embodiment in which the porous body has a multilayer structure will be described. In this explanation, the layer on the side to come into contact with the first image is a first layer, and the layer laminated on the surface opposite to the contact surface of the first layer with the first image is a second layer. For a structure including three or more layers, the layers are expressed in the laminating order successively from the first layer. In the present specification, the first layer is also called "absorbing layer", and the second and subsequent layers are also called "support layer".

[First Layer]

The first layer can be formed from the porous body previously described in the section of "(Porous body)".

In order to suppress coloring material adhesion and to improve cleanability, the above-described water-repellent porous body is preferably used as the first layer. These resins can be used singly or in combination of two or more of them as needed. A plurality of films may be laminated in the first layer.

A first layer composed of a water-repellent material has almost no function of sucking an aqueous liquid component by capillary force, and may take time to suck a liquid when coming into contact with an image for the first time. On this account, the first layer is preferably impregnated with a wetting liquid having a contact angle with the first layer of less than 90°. The wetting liquid can be infiltrated into the first layer by application onto the first surface of the liquid absorbing member, for example. The wetting liquid is preferably prepared by mixing a liquid medium containing water with a surfactant or a liquid having a low contact angle with the first layer. The wetting liquid impregnated into the porous body is gradually replaced with the aqueous liquid component absorbed from first images, and thus the absorption efficiency of the first layer may be gradually reduced. To address this reduction, the wetting liquid is preferably applied to the first surface of the porous body of the liquid absorbing member after a predetermined number of times.

In the present invention, the first layer preferably has a film thickness of 50 μm or less. The film thickness is more preferably 30 μm or less. In examples of the present invention, the film thickness was determined by measuring film thicknesses at any 10 points with a linear micrometer, OMV-25 (trade name, manufactured by Mitutoyo) and calculating the average.

The first layer can be produced by a known method for producing a thin porous film. For example, a resin material can be subjected to extrusion molding or a similar technique to give a sheet-like material, and the sheet-like material can be drawn into an intended thickness, yielding a first layer. Alternatively, a plasticizer such as paraffin can be added to the material for extrusion molding, and the plasticizer can be removed, for example, by heating at the time of drawing, yielding a porous film. The pore diameter can be adjusted by appropriately controlling the amount of a plasticizer added, the draw ratio, and the like.

[Second Layer]

In the present invention, the second layer is preferably a layer having breathability. Such a layer can be either a nonwoven fabric or a woven fabric of resin fibers. The second layer may be made from any material. In order to prevent the liquid absorbed by the first layer from flowing back, the contact angle of a preferred material with an aqueous liquid component absorbed from an image is equal to or lower than that of the first layer. Specifically, the material is preferably selected from raw materials such as polyolefins (including polyethylene (PE) and polypropylene (PP)), polyurethanes, nylons, polyamides, polyesters (including polyethylene terephthalate (PET)), and polysulfone (PSF), and composite materials of them, for example. The second layer is preferably a layer having a larger pore diameter than that of the first layer.

[Third Layer]

In the present invention, the porous body having a multilayer structure may include three or more layers and is not limited. The third and subsequent layers are preferably a nonwoven fabric from the viewpoint of rigidity. As the material, a similar material to that for the second layer can be used.

[Other Materials]

The liquid absorbing member may include, in addition to the porous body having a multilayer structure, a reinforcing member that reinforces side surfaces of the liquid absorbing member. The liquid absorbing member may also include a joining member that joins the longitudinal ends of a long sheet-like porous body to form a belt-like member. For example, a non-porous tape material can be used as such a material and can be placed at a position or a cycle with which images do not come into contact.

[Production Method of Porous Body]

The method of laminating the first layer and the second layer to form the porous body may be any method. The layers can be simply laminated or can be bonded to each other by a technique such as lamination by an adhesive agent or lamination by heating. From the viewpoint of breathability, lamination by heating is preferred in the present invention. Alternatively, the first layer or the second layer may be partly melted by heat, for example, and the layers may be adhesively laminated. A fusing material such as a hot melt powder may be interposed between the first layer and the second layer, and the layers may be adhesively laminated by heating. When a third or subsequent layer is laminated, layers may be laminated at once, or may be laminated successively. The lamination order is appropriately selected.

In the heating step, preferred is a lamination method in which porous bodies are heated while the porous bodies are interposed between heated rollers and pressed.

Next, a specific embodiment of the ink jet recording apparatus will be described.

As the ink jet recording apparatus, each of the following two apparatus configurations can be adopted.

(1) An ink jet recording apparatus in which a first image is formed on a transfer body as the ink receiving medium and a second image after aqueous liquid component absorption by a liquid absorbing member is transferred to a recording medium.

(2) An ink jet recording apparatus in which a first image is formed on a recording medium as the ink receiving medium and a second image after aqueous liquid component absorption by a liquid absorbing member is formed.

The ink jet recording apparatus described in (1) is called transfer type ink jet recording apparatus for convenience hereinafter. The ink jet recording apparatus described in (2) is called direct drawing type ink jet recording apparatus for convenience hereinafter.

Each ink jet recording apparatus will next be described.

(Transfer Type Ink Jet Recording Apparatus)

FIG. 1 is a schematic view showing an exemplary schematic structure of a transfer type ink jet recording apparatus 100 of the embodiment.

The transfer type ink jet recording apparatus 100 includes a transfer body 101 for temporarily holding a first image and a second image formed by absorbing/removing at least a part of the aqueous liquid component from the first image. The transfer type ink jet recording apparatus 100 further includes a pressing member for transferring 106 that transfers the second image onto a recording medium on which an image is to be formed, or onto a recording medium for forming a final image depending on an intended purpose.

The transfer type ink jet recording apparatus 100 includes the transfer body 101 supported by a support member 102, a reaction liquid applying device 103 for applying a reaction liquid onto the transfer body 101, an ink applying device 104 for applying an ink onto the transfer body 101 with the reaction liquid to form a first image on the transfer body, a liquid absorbing device 105 for absorbing a liquid component from the first image on the transfer body, and the transfer member 106 for pressing a recording medium 108 to transfer a second image from which the liquid component has been removed on the transfer body onto the recording medium 108 such as paper. The transfer type ink jet recording apparatus 100 may further include a cleaning member 109 for a transfer body for cleaning the surface of the transfer body 101 after transfer of the second image onto the recording medium 108.

The support member 102 rotates around a rotating shaft 102*a* as the center in an arrow direction in FIG. 1. By rotating the support member 102, the transfer body 101 moves. On the moving transfer body 101, a reaction liquid and an ink are sequentially applied by the reaction liquid applying device 103 and the ink applying device 104, respectively, and a first image is formed on the transfer body 101. As the transfer body 101 moves, the first image formed on the transfer body 101 moves to the position at which a liquid absorbing member 105*a* of the liquid absorbing device 105 comes into contact.

The liquid absorbing member 105*a* of the liquid absorbing device 105 synchronizes with the rotation of the transfer body 101. The first image formed on the transfer body 101 undergoes the state of contact with the moving liquid absorbing member 105*a*. During the contact state, the liquid absorbing member 105*a* removes a liquid component containing at least an aqueous liquid component from the first image.

By subjecting the first image to the state of contact with the liquid absorbing member 105*a*, the liquid component contained in the first image is removed. In the state of contact, the liquid absorbing member 105*a* is preferably pressed against the first image at a certain pressing force for helping the liquid absorbing member 105*a* to function effectively.

The removal of the liquid component can be expressed from a different point of view as concentrating the ink constituting the image formed on the transfer body. Concentrating the ink means that the proportion of the solid content contained in the ink, such as coloring material and resin, with respect to the liquid component contained in the ink increases owing to reduction in the liquid component.

As the transfer body 101 moves, the second image after removal of the liquid component from the first image moves to a transfer unit at which the second image comes into contact with a recording medium conveyed by a recording medium conveyance device 107. While the second image from which the liquid component has been removed is in contact with the recording medium 108, pressing by the pressing member 106 against the recording medium 108 allows the image (ink image) to be formed on the recording medium. The ink image after transfer onto the recording medium 108 is a reverse image of the second image. The ink image after transfer is also called third image, separately from the first image (ink image before liquid removal) and the second image (ink image after liquid removal) described above.

On the transfer body, the reaction liquid is applied, and then the ink is applied to form the image. Thus, the reaction liquid is not reacted with the ink and is left in a non-image region (no ink image formation region). In the apparatus, the liquid absorbing member 105*a* comes into contact with not only the image but also the unreacted reaction liquid and removes also a liquid component in the reaction liquid from the surface of the transfer body 101.

Although the above description expresses that the liquid component is removed from the image, the expression is not limited to removal of the liquid component only from the image, but means that the liquid component is removed at least from the image formation region on the transfer body. For example, the liquid component in the reaction liquid applied to a region outside the first image can be removed together from the first image.

The liquid component may be any liquid component that does not have a certain shape and have flowability and a substantially constant volume. The liquid component is exemplified by water and an organic solvent contained in an ink or a reaction liquid.

Even when the clear ink is contained in a first image, the ink can be concentrated by the liquid absorption treatment. For example, when a clear ink is applied onto a color ink containing a coloring material applied onto the transfer body 101, the clear ink is present on the whole surface of the first image, or the clear ink is partly present at a position or a plurality positions on the surface of the first image and the color ink is present at the other positions. At the positions at which the clear ink is present on the color ink in the first image, the porous body absorbs the liquid component in the clear ink on the surface of the first image, and the liquid component in the clear ink moves. Accordingly, the liquid component in the color ink moves to the porous body, and the aqueous liquid component in the color ink is absorbed. Meanwhile, in the area in which clear ink regions and color ink regions are present on the surface of the first image, the respective liquid components of the color ink and the clear ink move to the porous body, and the aqueous liquid components are absorbed. The clear ink may contain a large amount of a component for improving the transferability of an image from the transfer body 101 to a recording medium. For example, the proportion of a component having such a stickiness to a recording medium as to be increased by heat as compared with a color ink can be increased.

Components constituting the transfer type ink jet recording apparatus of the embodiment will next be described.

<Transfer Body>

The transfer body 101 includes a surface layer having an image formation surface. As the member for the surface layer, various materials such as resins and ceramics can be appropriately used, but a material having a high compressive elastic modulus is preferred from the viewpoint of durability and the like. Specifically exemplified are an acrylic resin, an acrylic silicone resin, a fluorine-containing resin, and a condensate prepared by condensation of a hydrolyzable organic silicon compound. In order to improve the wettability of a reaction liquid, transferability, and the like, surface treatment may be performed. The surface treatment is exemplified by flame treatment, corona treatment, plasma treatment, polishing treatment, roughening treatment, active energy ray-irradiation treatment, ozone treatment, surfactant treatment, and silane coupling treatment. These treatments may be performed in combination. Any surface shape may be provided on the surface layer.

The transfer body preferably includes a compressible layer having such a function as to absorb pressure fluctuations. A provided compressible layer absorbs deformation to disperse local pressure fluctuations, and satisfactory transferability can be maintained even during high speed printing. The member for the compressible layer is exemplified by acrylonitrile-butadiene rubber, acrylic rubber, chloroprene rubber, urethane rubber, and silicone rubber. It is preferred that when such a rubber material is molded, predetermined amounts of a vulcanizing agent, a vulcanization accelerator, and the like be added, and a foaming agent, hollow microparticles, or a filler such as sodium chloride be further added as needed to form a porous material. In such a porous compressible layer, bubble portions are compressed with volume changes against various pressure fluctuations, thus deformation except in a compression direction is small, and more stable transferability and durability can be achieved. The porous rubber material includes a material having a continuous pore structure in which pores are connected to each other and a material having a closed pore structure in which pores are independent of each other. In the present invention, either of the structures may be used, or the structures may be used in combination.

The transfer body preferably further includes an elastic layer between the surface layer and the compressible layer. As the member for the elastic layer, various materials such as resins and ceramics can be appropriately used. From the viewpoint of processing characteristics and the like, various elastomer materials and rubber materials are preferably used. Specific examples include fluorosilicone rubber, phenylsilicone rubber, fluororubber, chloroprene rubber, urethane rubber, nitrile rubber, ethylene-propylene rubber, natural rubber, styrene rubber, isoprene rubber, butadiene rubber, ethylene/propylene/butadiene copolymers, and nitrile-butadiene rubber. Specifically, silicone rubber, fluorosilicone rubber, and phenylsilicone rubber, which have a small compress set, are preferred from the viewpoint of dimensional stability and durability. The temperature change in elastic modulus of such a material is small, and thus the above materials are preferred from the viewpoint of transferability.

Between the layers constituting the transfer body (the surface layer, the elastic layer, and the compressible layer), various adhesives or two-sided adhesive tapes may be interposed in order to fix/hold the layers. The transfer body may also include a reinforcing layer having a high compressive elastic modulus in order to suppress lateral elongation when installed in an apparatus or to maintain resilience. A woven fabric may be used as the reinforcing layer. The transfer body can be prepared by combination of any layers made from the above materials.

The size of the transfer body can be freely selected depending on the size of an intended print image. The shape of the transfer body may be any shape and is specifically exemplified by a sheet shape, a roller shape, a belt shape, and an endless web shape.

<Support Member>

The transfer body 101 is supported on a support member 102. As the supporting manner of the transfer body, various adhesives or double-sided adhesive tapes may be used. Alternatively, by attaching an installing member made from a metal, ceramics, a resin, or the like to the transfer body, the transfer body may be supported on the support member 102 by using the installing member.

The support member 102 is required to have a certain structural strength from the viewpoint of conveyance accuracy and durability. As the material for the support member, metals, ceramics, resins, and the like are preferably used. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. It is also preferred to use these materials in combination.

<Reaction Liquid Applying Device>

The ink jet recording apparatus of the embodiment includes a reaction liquid applying device 103 for applying a reaction liquid onto the transfer body 101. The reaction liquid applying device 103 in FIG. 1 shows the case of a gravure offset roller including a reaction liquid storage unit 103*a* for storing a reaction liquid and reaction liquid applying members 103*b*, 103*c* for applying the reaction liquid in the reaction liquid storage unit 103*a* onto the transfer body 101.

<Ink Applying Device>

The ink jet recording apparatus of the embodiment includes an ink applying device 104 for applying an ink onto the transfer body 101 onto which the reaction liquid has been applied. The reaction liquid and the ink are mixed to form a first image, and a liquid component is absorbed from the first image by the subsequent liquid absorbing device 105.

<Liquid Absorbing Device>

In the present embodiment, the liquid absorbing device 105 includes a liquid absorbing member 105*a* and a pressing member 105*b* for liquid absorption for pressing the liquid absorbing member 105*a* against a first image on the transfer body 101.

The pressing member 105*b* functions to press the second surface of the liquid absorbing member 105*a*, and accordingly the first surface is brought into contact with the circumference surface of the transfer body 101 to form a nip. By passing a first image through the nip, the liquid absorption treatment from the first image can be performed. The region in which the liquid absorbing member 105*a* can be brought into pressure contact with the circumference surface of the transfer body 101 is used as a liquid absorption treatment region.

The position of the pressing member 105*b* relative to the transfer body 101 can be controlled by a position control mechanism (not shown in the drawings). For example, a pressing member 105*b* capable of reciprocating in the direction of the double-headed arrow A shown in FIG. 1 can be used to bring the liquid absorbing member 105*a* into contact with the circumference surface of the transfer body 101 at the timing when the liquid absorption treatment is required. In addition, the pressing member 105*b* can be separated from the circumference surface of the transfer body 101 when the liquid absorbing device is subjected to maintenance or the like.

The liquid absorbing member 105*a* and the pressing member 105*b* may have any shape. Such a configuration as shown in FIG. 1 is exemplified. In the configuration, the pressing member 105*b* has a column shape, the liquid absorbing member 105*a* has a belt shape, and the column-like pressing member 105*b* presses the belt-like liquid absorbing member 105*a* against the transfer body 101. In another exemplified configuration, the pressing member 105*b* has a column shape, the liquid absorbing member 105*a* has a hollow column shape formed on the peripheral surface of the pressing member 105*b*, and the column-like pressing member 105*b* presses the hollow column-like liquid absorbing member 105*a* against the transfer body.

In the present invention, the liquid absorbing member 105*a* preferably has a belt shape in consideration of the space in the ink jet recording apparatus, for example.

The liquid absorbing device 105 including such a belt-like liquid absorbing member 105*a* may also include extending members for extending the liquid absorbing member 105*a*. In FIG. 1, 105*c*, 105*d*, and 105*e* are extending rollers as the extending members. These rollers and a belt-like liquid absorbing member 105*a* extended by the rollers constitute a conveyance unit that conveys the porous body for the liquid absorption treatment from a first image. The conveyance unit enables carrying-in, carrying-out, and re-carrying of the porous body to and from the liquid absorption treatment region.

In FIG. 1, the pressing member 105*b* is also a roller member rotating as with the extending rollers, but is not limited to this.

In the liquid absorbing device 105, the liquid absorbing member 105*a* including a porous body is pressed by the pressing member 105*b* against a first image to allow the liquid absorbing member 105*a* to absorb a liquid component contained in the first image, thereby removing the liquid component from the first image. As the method of removing the liquid component in the first image, the present system of pressing the liquid absorbing member may be combined with other various conventional techniques such as a heating method, a method of blowing air with low humidity, and a decompression method.

(Pretreatment)

The liquid absorbing device 105 may include a wetting liquid applying device constituting a wetting liquid applying unit, as needed.

When used, a water-repellent porous body can be subjected to a pretreatment before the porous body is brought into contact with a first image, by using a wetting liquid applying device (not shown in the drawings) that applies a wetting liquid having a contact angle with the porous body of less than 90°.

The wetting liquid may be any liquid that maintains, recovers, or improves the liquid absorbability of a porous body. The wetting liquid is preferably a liquid having a contact angle of less than 90° with the first surface of a porous body and capable of improving the liquid absorbability of a porous body.

To an aqueous liquid medium such as water and a mixture of water and a water-soluble organic solvent, a surfactant can be added to appropriately adjust the surface tension thereof, and the resulting liquid can be used as the wetting liquid.

The material used for the preparation of the wetting liquid is not limited to particular materials, and a surfactant is preferably used. As the surfactant, at least one of a silicone surfactant and a fluorochemical surfactant is preferably used.

The surfactant specifically used is exemplified by fluorochemical surfactants such as F-444 (trade name, manufactured by DIC), Zonyl FS3100 (trade name, manufactured by DuPont), and Capstone FS-3100 (trade name, manufactured by The Chemours Company LLC) and silicone surfactants such as BYK349 (trade name, manufactured by BYK). The water is preferably a deionized water prepared by ion exchanging, for example. The water-soluble organic solvent is not limited to particular types, and any known organic solvent such as ethanol and isopropyl alcohol can be used.

The application method of the wetting liquid to the porous body used in the present invention may be any method such as immersion, coating, and liquid dropping, but is preferably a roller pressure type application method for stable application of the wetting liquid, high-speed application in an apparatus, and the like.

The application method of the wetting liquid to the porous body used in the present invention may be any method such as immersion and liquid dropping, but is preferably a roller pressure system for stable application of the wetting liquid, high-speed application in an apparatus, and the like.

In the present invention, the timing of the application of the wetting liquid may be any timing. When a drum-like or endless web-like liquid absorbing member is continuously, circularly conveyed to perform the pretreatment, the wetting liquid may be applied every cycle or may be applied once after several cycles, for example. The application timing of the wetting liquid can be appropriately adjusted. The wetting liquid applying member may be configured to move up and down by using a motor, a cam mechanism, or an air cylinder. This configuration enables the wetting liquid applying member to come in contact with or to separate from the liquid absorbing member.

The wetting liquid applying device can be provided so that the wetting liquid applying device can move to a position where the wetting liquid is applied to the liquid absorbing member 105*a* and can separate from the liquid absorbing member 105*a* at an intended timing. For example, when placed on an elevating stage (not shown in the drawings) capable of moving up and down by an elevating air cylinder (not shown in the drawings), the wetting liquid applying device can reciprocate as mentioned above.

The application pressure of the wetting liquid is not limited to particular values, but is preferably 0.981 $N/cm^2$ (0.1 $kgf/cm^2$) or more because the wetting liquid can be stably applied or can be applied at high speed in an apparatus. The pressure is also preferably 98.07 $N/cm^2$ (10 $kgf/cm^2$) or less because the structural load on an apparatus is suppressed.

(Pressing Conditions)

The pressure of the porous body pressing against an image on the transfer body is preferably 2.94 N/cm$^2$ (0.3 kgf/cm$^2$) or more because the liquid component in the first image can be separated by solid-liquid separation for a shorter time and the liquid component can be removed from the first image. The pressure is preferably 98.07 N/cm$^2$ (10 kgf/cm$^2$) or less because the structural load on an apparatus is suppressed. In the present invention, the contact pressure of a porous body against a first image represents the nip pressure between a transfer body 101 and a liquid absorbing member 105*a*, and is the value determined by the following procedure. A surface pressure distribution measuring device (I-SCAN (trade name), manufactured by Nitta) is used to perform surface pressure measurement, and the load in a pressed region is divided by the area, giving the pressure.

(Application Time)

The application time for contact of the liquid absorbing member 105*a* with a first image is preferably within 50 ms (milliseconds) in order to further suppress adhesion of the coloring material in the first image to the liquid absorbing member. In the present specification, the application time is calculated by dividing the pressure detection width in a movement direction of the ink receiving medium in the above surface pressure measurement by the movement speed of the ink receiving medium. Hereinafter, the application time is called liquid absorbing nip time.

In this manner, a second image in which the liquid component is absorbed from the first image to reduce the liquid component is formed on the transfer body 101. The second image is next subjected to a heat drying treatment with a heat drying device.

(Heat Drying Device)

At a downstream side of the liquid absorbing device 105 in the conveyance direction of the transfer body 101, a heat drying device 13 for heat drying treatment of a second image to remove the liquid component remaining after the absorption with the liquid absorbing device 105 is provided.

Before the heat drying device 13, or at an upstream side in the conveyance direction of the transfer body 101, a temperature sensor 40 constituting a second temperature measuring unit that measures the temperature of a second image is provided at or around the inlet of a heat drying treatment region.

After the heat drying device 13, or at a downstream side in the conveyance direction of the transfer body 101, a temperature sensor 41 constituting a first temperature measuring unit that measures the temperature of a second image is provided at or around the outlet of the heat drying treatment region.

By using the heat drying device 13 to remove the water, solvents, and the like remaining after the removal with the liquid absorbing device 105, the energy used for drying images can be reduced in the whole apparatus. The heat drying treatment unit used as the heat drying device 13 may be any device, and the heat drying treatment unit is exemplified by a unit of directly heating a second image from the second image surface and a unit of heating an ink receiving medium to indirectly heat a second image through the ink receiving medium. At least one of the two units can be used. Combination use of both the units is more preferred. The specific heating technique is exemplified by heating by hot air, infrared heating, and heating with a halogen heater.

The heating temperature of a second image by the heat drying device may be any temperature at which a second image becomes in an intended dried state. In addition to the drying effect, the heating temperature is preferably such a temperature that a resin component in a second image applied as a component in an ink will turn into a film. When resin microparticles are used as the resin component in an ink, the heating temperature is preferably not lower than at least MFT (minimum film-forming temperature) of the resin microparticles.

The temperature of a second image before being subjected to the heat drying treatment can be set depending on formation conditions of a first image, such as the formulation and the discharging amount of an ink and the application amount of a reaction liquid, and can be controlled within a range of 40 to 70° C. by using a temperature control device, as needed. In this case, the heating temperature by the heat drying device is higher than the temperature before the heat drying treatment, and can be selected from the temperature range lower than about 200° C., for example.

The temperature measuring member used in the temperature measuring unit of the temperature measuring device may be any member capable of performing an intended temperature measurement. As the temperature measuring member, a noncontact type temperature sensor is preferably used. The noncontact type temperature sensor is exemplified by a radiation temperature sensor. The detection temperature range is preferably from a normal temperature to 500° C., and the response speed is preferably 20 msec or less.

<Pressing Member for Transferring>

In the apparatus of the present embodiment, during contact of the second image with a recording medium 108 conveyed by a recording medium conveyance device 107, a pressing member for transferring 106 presses the recording medium 108, thereby transferring the ink image onto the recording medium 108. The liquid component is removed from an image on the transfer body 101, then the image is transferred onto the recording medium 108, and consequently a recorded image prevented from causing curing, cockling, and the like can be produced.

The pressing member 106 is required to have a certain structural strength from the viewpoint of the conveyance accuracy of a recording medium 108 and durability. As the material for the pressing member 106, metals, ceramics, resins, and the like are preferably used. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. These materials may be used in combination.

The pressing time of the pressing member 106 for transferring a second image on the transfer body 101 to a recording medium 108 is not limited to particular values, but is preferably 5 ms or more to 100 ms or less in order to satisfactory transfer the image and not to degrade the durability of the transfer body. The pressing time in the embodiment represents the time during the contact of a recording medium 108 with a transfer body 101 and is the value determined by the following procedure. A surface pressure distribution measuring device (I-SCAN (trade name), manufactured by Nitta) is used to perform surface pressure measurement, and the length in the conveyance direction of a pressed region is divided by the conveyance speed, giving the pressing time.

The pressure by the pressing member 106 for transferring a second image on the transfer body 101 to a recording medium 108 is not limited to particular values, but is controlled so as to satisfactory transfer the image and not to degrade the durability of the transfer body. Thus, the pressure is preferably 9.8 N/cm$^2$ (1 kg/cm$^2$) or more to 294.2 N/cm$^2$ (30 kg/cm$^2$) or less. The pressure in the embodiment represents the nip pressure between a recording medium 108 and a transfer body 101, and is a value determined by the following procedure. A surface pressure distribution measuring device is used to perform surface pressure measurement, and the load in a pressed region is divided by the area, giving the pressure.

The temperature during pressing by the pressing member 106 for transferring a second image on the transfer body 101 to a recording medium 108 is also not limited to particular values, but is preferably not lower than the glass transition point or not lower than the softening point of the resin component contained in an ink. A preferred embodiment for heating includes a heating device for heating a second image on the transfer body 101, the transfer body 101, and a recording medium 108.

The shape of the transfer member 106 is not limited to particular shapes, but is exemplified by a roller shape.

<Recording Medium and Recording Medium Conveyance Device>

In the present embodiment, the recording medium 108 is not limited to particular media, and any known recording medium can be used. The recording medium is exemplified by long media rolled into a roll and sheet media cut into a certain size. The material is exemplified by paper, plastic films, wooded boards, corrugated cardboard, and metal films.

In FIG. 1, the recording medium conveyance device 107 for conveying the recording medium 108 is composed of a recording medium delivery roller 107*a* and a recording medium winding roller 107*b*, but may be composed of any members capable of conveying a recording medium, and is not specifically limited to the structure.

<Control System>

Figure 3:
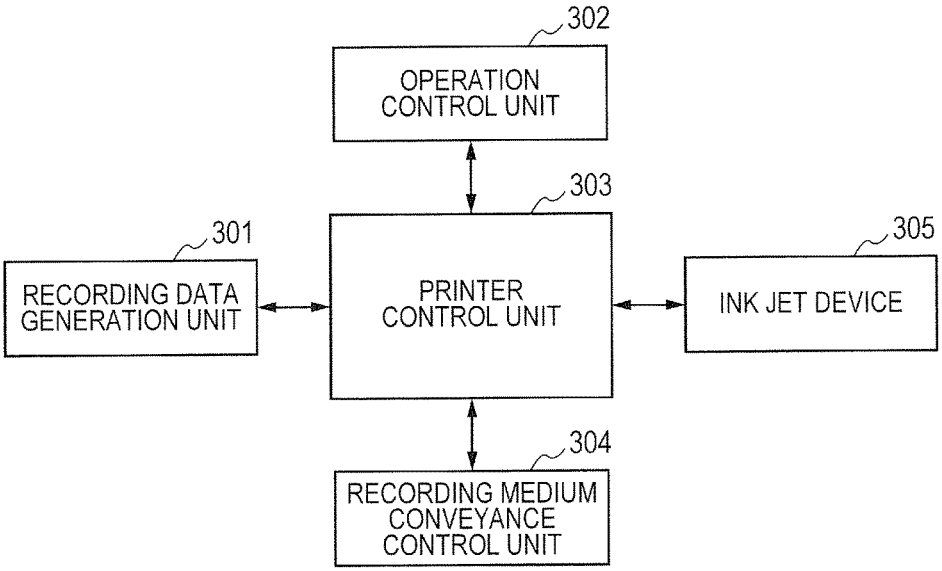
FIG. 3 is a block diagram of a control system for the whole ink jet recording apparatuses shown in FIGS. 1 and 2.

The transfer type ink jet recording apparatus in the embodiment has a control system for controlling each device. FIG. 3 is a block diagram of a control system for the whole transfer type ink jet recording apparatus shown in FIG. 1.

In FIG. 3, 301 is a recording data generation unit such as an external print server, 302 is an operation control unit such as an operation panel, 303 is a printer control unit for executing a recording process, 304 is a recording medium conveyance control unit for conveying a recording medium, and 305 is an ink jet device for printing.

Figure 4:
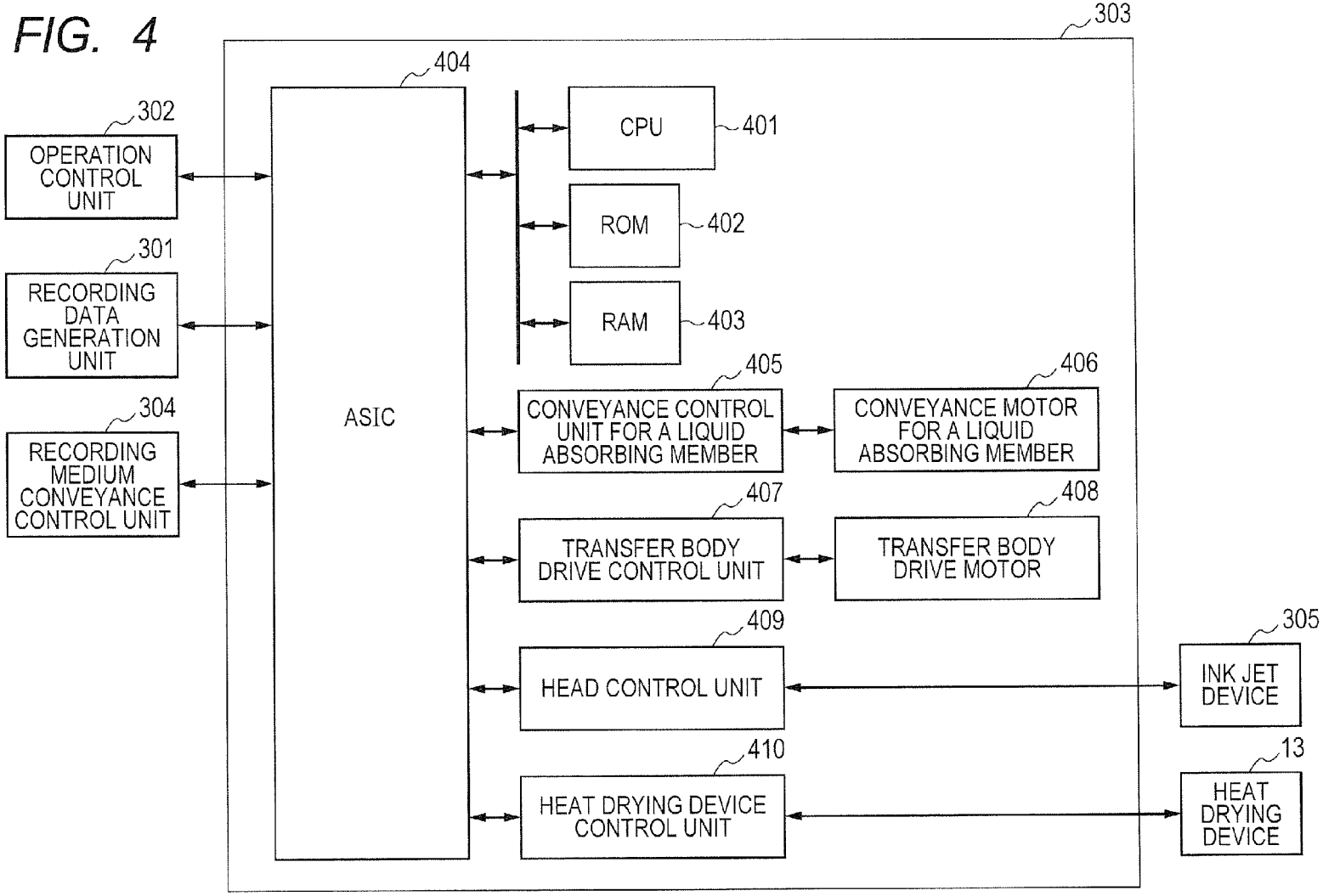
FIG. 4 is a block diagram of a printer control unit in the transfer type ink jet recording apparatus shown in FIG. 1.

FIG. 4 is a block diagram of the printer control unit in the transfer type ink jet recording apparatus in FIG. 1.

401 is a CPU for controlling the whole printer, 402 is a ROM for storing a control program for the CPU, and 403 is a RAM for executing a program. 404 is an application specific integrated circuit (ASIC) including a network controller, a serial IF controller, a controller for generating head data, a motor controller, and the like. 405 is a conveyance control unit for a liquid absorbing member for driving a conveyance motor 406 for a liquid absorbing member and is controlled by a command from the ASIC 404 via a serial IF. 407 is a transfer body drive control unit for driving a transfer body drive motor 408 and is also controlled by a command from the ASIC 404 via a serial IF. 409 is a head control unit and performs final discharge data generation for the ink jet device 305 and drive voltage generation, for example.

The determination unit can include a control unit that determines the working state of a device to be determined and performs control based on the determination result. The control unit includes a RAM for recording temperatures measured for determination, a ROM for storing the data to set a threshold for determination (for example, a list of ink discharging amounts and temperature increases), an integrated circuit for giving a direction to the control unit of a device to be determined and controlled, and the like. The direction to the control unit of a device to be determined and controlled can be performed in accordance with the sequence shown in FIG. 6. Specifically, the operation control unit activates a printer, then the control unit activates temperature sensors to read the temperatures before and after being subjected to the heat drying treatment by the heat drying device, and the RAM records the read temperature values. From the temperature sensor values recorded in the RAM, at least one of the conveyance control unit 405 for a liquid absorbing member, the head control unit 409, and the heat drying apparatus control unit 410 is used to perform image defect detection/apparatus control in accordance with the sequence in FIG. 6.

(Direct Drawing Type Ink Jet Recording Apparatus)

As another embodiment of the present invention, a direct drawing type ink jet recording apparatus is exemplified. In the direct drawing type ink jet recording apparatus, the ink receiving medium is a recording medium on which an image is to be formed.

Figure 2:
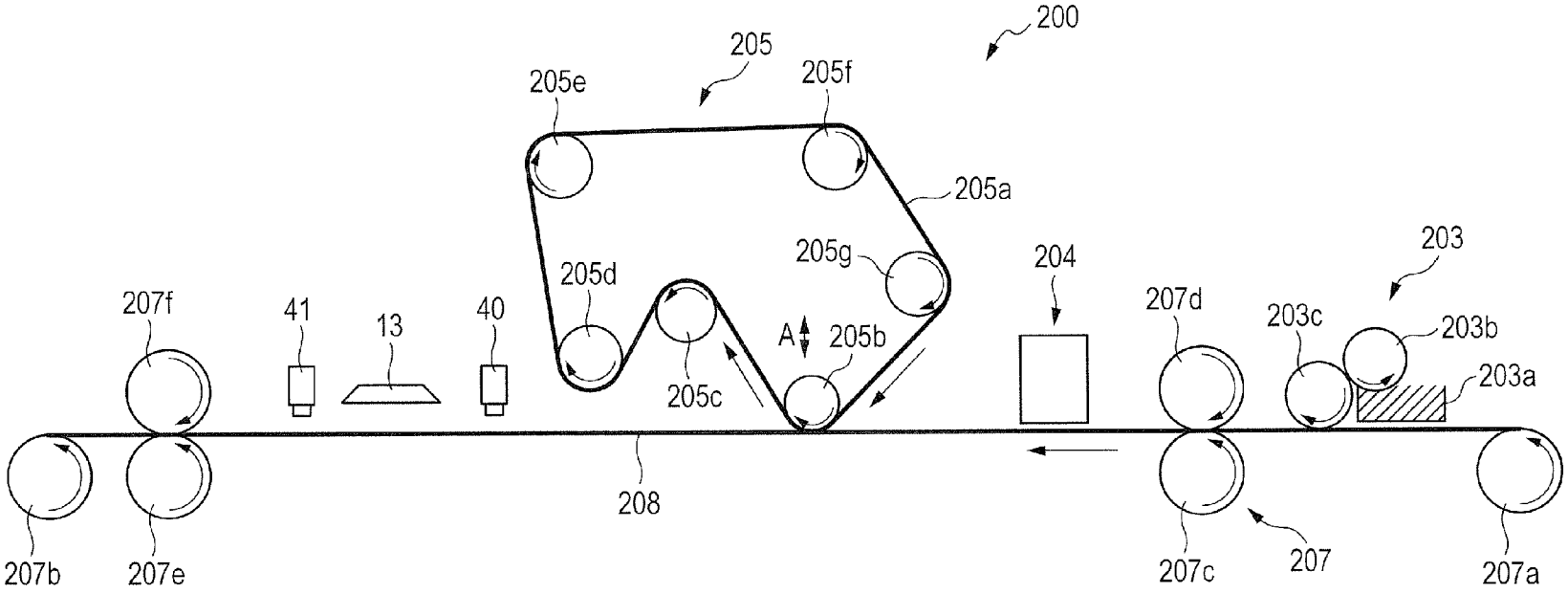
FIG. 2 is a schematic view showing an exemplary structure of a direct drawing type ink jet recording apparatus in the present invention.

FIG. 2 is a schematic view showing an exemplary schematic structure of a direct drawing type ink jet recording apparatus 200 in the embodiment. As compared with the above transfer type ink jet recording apparatus, the direct drawing type ink jet recording apparatus includes the same units as the transfer type ink jet recording apparatus except that the transfer body 101, the support member 102, and the cleaning member 109 for a transfer body are not included, and an image is formed on a recording medium 208.

Hence, a reaction liquid applying device 203 for applying a reaction liquid onto the recording medium 208, an ink applying device 204 for applying an ink onto the recording medium 208, and a liquid absorbing device 205 including a liquid absorbing member 205*a* that comes into contact with a first image on the recording medium 208 to absorb a liquid component contained in the first image have the same structures as those in the transfer type ink jet recording apparatus, and are not described.

In the direct drawing type ink jet recording apparatus of the embodiment, the liquid absorbing device 205 includes the liquid absorbing member 205*a* and a pressing member 205*b* for liquid absorption that presses the liquid absorbing member 205*a* against the first image on the recording medium 208. The liquid absorbing member 205*a* and the pressing member 205*b* may have any shape, and members having substantially the same shapes as those of the liquid absorbing member and the pressing member usable in the transfer type ink jet recording apparatus can be used. The liquid absorbing device 205 may further include extending members for extending the liquid absorbing member. In FIG. 2, 205*c*, 205*d*, 205*e*, 205*f*, and 205*g* are extending rollers as the extending members. The number of extending rollers is not limited to 5 as shown in FIG. 4, and an intended number of rollers can be arranged depending on the design of an apparatus. The direct drawing type ink jet recording apparatus may further include recording medium support members, not shown in the drawings, for supporting the recording medium from below, at a position opposed to an ink applying unit including the ink applying device 204 for applying an ink to the recording medium 208 and a position opposed to a liquid component removing unit including the liquid absorbing member 205*a* that comes into contact with a first image on the recording medium to remove a liquid component.

Although not shown in the drawings, the above-described wetting liquid applying device is preferably also included as described in the transfer type ink jet recording apparatus in FIG. 1.

<Recording Medium Conveyance Device>

In the direct drawing type ink jet recording apparatus of the embodiment, a recording medium conveyance device 207 is not limited to particular devices, and a conveyance device in a known direct drawing type ink jet recording apparatus can be used. As shown in FIG. 2, a recording medium conveyance device including a recording medium delivery roller 207*a*, a recording medium winding roller 207*b*, and recording medium conveyor rollers 207*c*, 207*d*, 207*e*, and 207*f* is exemplified.

<Control System>

The direct drawing type ink jet recording apparatus in the embodiment has a control system for controlling each device. A block diagram of the control system for the whole direct drawing type ink jet recording apparatus shown in FIG. 2 is as shown in FIG. 3 as with the transfer type ink jet recording apparatus shown in FIG. 1.

Figure 5:
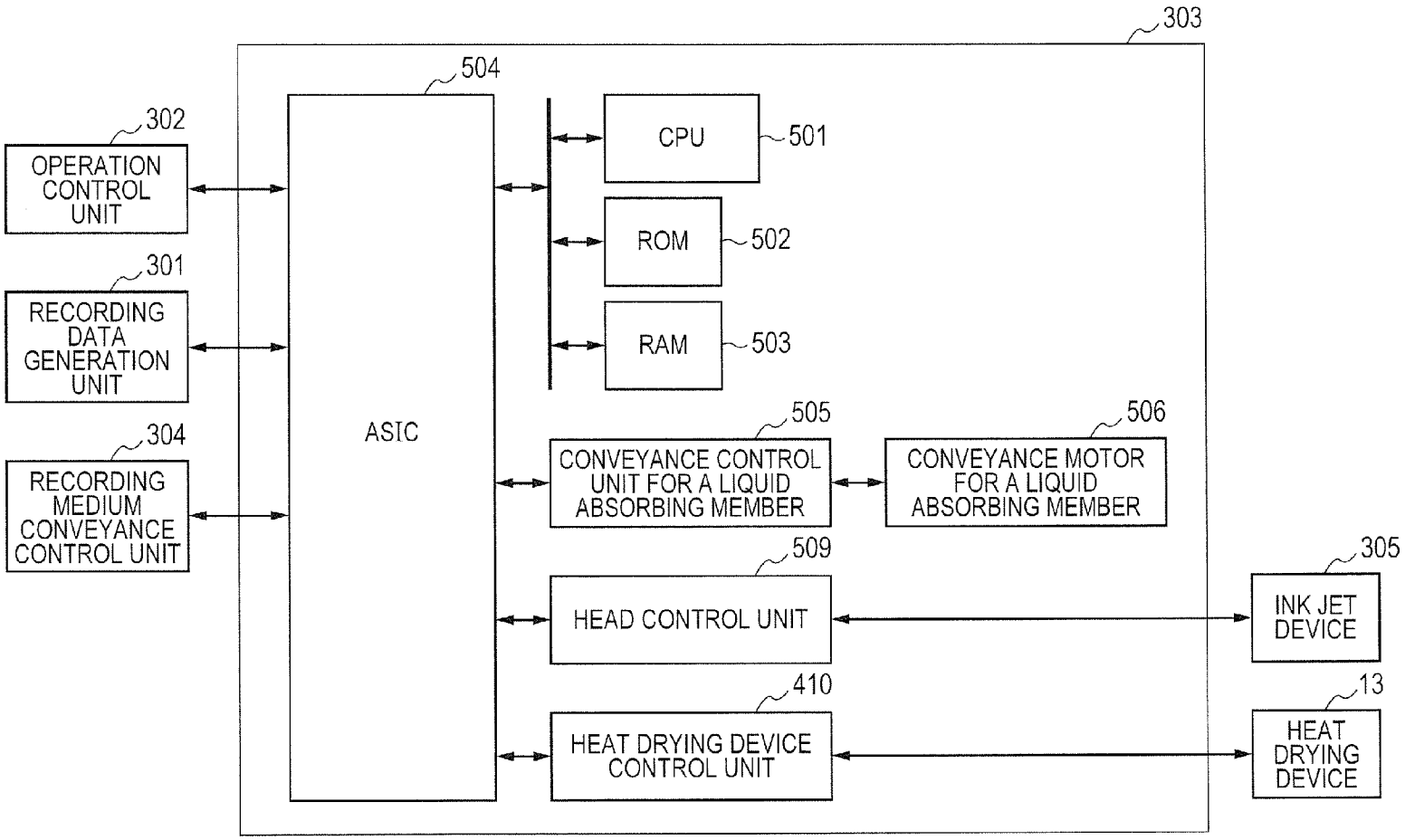
FIG. 5 is a block diagram of a printer control unit in the direct drawing type ink jet recording apparatus shown in FIG. 2.

FIG. 5 is a block diagram of the printer control unit in the direct drawing type ink jet recording apparatus in FIG. 2. The block diagram is the same as the block diagram of the printer control unit in the transfer type ink jet recording apparatus in FIG. 4 except that the transfer body drive control unit 407 and the transfer body drive motor 408 are not included.

In other words, 501 is a CPU for controlling the whole printer, 502 is a ROM for storing a control program for the CPU, and 503 is a RAM for executing a program. 504 is an ASIC including a network controller, a serial IF controller, a controller for generating head data, a motor controller, and the like. 505 is a conveyance control unit for a liquid absorbing member for driving a conveyance motor 506 for a liquid absorbing member and is controlled by a command from the ASIC 504 via a serial IF. 509 is a head control unit and performs final discharge data generation for the ink jet device 305 and drive voltage generation, for example.

The direct drawing type ink jet recording apparatus can also include a determination unit having such a structure as described in the transfer type ink jet recording apparatus.

Information about the paper (recording medium) type can be obtained by comparison of data such as surface roughness and basis weight (weight) with previously stored library data or by information input from a user interface.

EXAMPLES

Next, an example of the ink jet recording apparatus of the present invention will be described in more detail. The present invention is not intended to be limited to the following examples without departing from the scope of the invention. In the following description in examples, "part" is based on mass unless otherwise noted.

Example 1

In the present example, the direct drawing type ink jet recording apparatus shown in FIG. 2 was used.

In the example, the surface of the recording medium 208 was warmed at 60° C. by a heating device not shown in the drawings.

As the reaction liquid to be applied by the reaction liquid applying device 203, the reaction liquid having the following formulation was used, and was applied at 1 g/m$^2$.

Glutaric acid: 21.0 parts
Glycerol: 5.0 parts
Surfactant (trade name: MEGAFACE F444, manufactured by DIC Corporation): 5.0 parts
Ion-exchanged water: remainder An ink was prepared by the following procedure.

<Preparation of Pigment Dispersion>

First, 10 parts of carbon black (trade name: Monarch 1100, manufactured by Cabot), 15 parts of a resin aqueous solution (prepared by neutralizing a 20.0% by mass aqueous solution of styrene-ethyl acrylate-acrylic acid copolymer having an acid value of 150 and a weight average molecular weight (Mw) of 8,000 with an aqueous potassium hydroxide), and 75 parts of pure water were mixed. The mixture was placed in a batch type vertical sand mill (manufactured by Aimex), and 200 parts of 0.3-mm zirconia beads were added. The mixture was dispersed for 5 hours while cooled with water. The dispersion liquid was centrifuged to remove coarse particles, and a black pigment dispersion having a pigment content of 10.0% by mass was prepared.

<Preparation of Resin Particle Dispersion>

First, 20 parts of ethyl methacrylate, 3 parts of 2,2'-azobis-(2-methylbutyronitrile), and 2 parts of n-hexadecane were mixed, and the mixture was stirred for 0.5 hour. The mixture was added dropwise to 75 parts of 8% aqueous solution of styrene-butyl acrylate-acrylic acid copolymer (acid value: 130 mg KOH/g, weight average molecular weight (Mw): 7,000), and the whole was stirred for 0.5 hour. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin particle dispersion having a resin content of 25.0% by mass.

<Preparation of Ink>

The resin particle dispersion and the pigment dispersion prepared above were mixed with the components shown below. The remainder of ion-exchanged water is such an amount that the total amount of all the components constituting the ink will be 100.0% by mass.

Pigment dispersion (a coloring material content of 10.0% by mass): 40.0% by mass
Resin particle dispersion: 20.0% by mass
Glycerol: 7.0% by mass
Polyethylene glycol (number average molecular weight (Mn): 1,000): 3.0% by mass
Surfactant: Acetylenol E100 (trade name, manufactured by Kawaken Fine Chemicals): 0.5% by mass
Ion-exchanged water: remainder The components were thoroughly stirred and dispersed and then subjected to pressure filtration through a microfilter with a pore size of 3.0 μm (manufactured by Fujifilm), giving a black ink.

As the ink applying device 204, an ink jet recording head including an electrothermal converter for discharging an ink on demand was used, and the ink application amount was 20 g/m$^2$. The liquid absorbing member 205*a* is controlled by conveyor rollers 205*c*, 205*d*, 205*e*, 205*f*, and 205*g*, which extend and convey the liquid absorbing member, so as to have substantially the same speed as the movement speed of the ink receiving medium 208. The recording medium 208 is conveyed by the recording medium delivery roller 207*a* and the recording medium winding roller 207*b* so as to be substantially the same speed as the movement speed of the ink receiving medium 208. In the example, the conveyance speed was 0.5 m/s, and Aurora Coat (trade name, manufactured by Nippon Paper Industries, basis weight: 104 g/m$^2$) was used as the recording medium 208.

The apparatus in FIG. 2 used in the example employs the system of conveying the recording medium 208 from the delivery roller 207*a* in the direction of the winding roller 207*b* in FIG. 2, and includes a heating unit not shown in the drawings to control the temperature at 60° C. except the heat treatment region heated by the heat drying device. First, the reaction liquid is applied to the recording medium 208 by the reaction liquid applying device 203. When the recording medium 208 arrives at the position of the ink applying device 204, the ink is discharged and reacted with the reaction liquid that has been applied to the recording medium 208 to form an ink image (first image) (not shown in the drawings) on the recording medium 208.

When the recording medium 208 arrives at the liquid absorbing device 205, a liquid component such as water content and a solvent is partially removed at the position of the pressing member 205*b*. When the ink image after the liquid absorption treatment (second image) arrives at the position of a temperature sensor 40 before being subjected to heat drying treatment, the temperature of the ink image before the heat drying treatment is measured and recorded as $T_{_Before}$ in an apparatus control unit (not shown in the drawings) included in the determination unit. In the example, FT-H20 (trade name, manufactured by Keyence Corporation) was used as the temperature sensor 40 before being subjected to heat drying treatment.

When the ink image after the liquid absorption treatment is passed through the heat treatment region by the heat drying device 13 as the recording medium 208 is conveyed, the ink image is subjected to the heat drying treatment, and the liquid component is further removed. When the ink image arrives at a temperature sensor 41 after heat drying treatment, the temperature of the ink image after the heat drying treatment is measured and recorded as $T_{_After}$ in the apparatus control unit 15.

Here, the ink image is preferably heated to 120° C. that is higher than the film-forming temperature of a resin contained in the ink. In the example, an infrared heating device was used as the heat drying device 13. Specifically, three infrared heaters, LHW-30 series (trade name, manufactured by Fintech) were arranged substantially perpendicular to the conveyance direction of the recording medium 208 and were used. In the example, $T_{_After}$ was used as the index for the occurrence of an image defect.

When a value of $T_{_After}$ recorded in the apparatus control unit is equal to or higher than a predetermined threshold temperature ($T_{_After}$-th range), it is determined that the liquid absorbing device 205 properly removes the liquid component from an ink image.

In contrast, when a value of $T_{_After}$ is lower than a predetermined threshold range ($T_{_After}$-th range), the occurrence of an image defect is determined due to an excess liquid component in an ink image. In other words, the liquid absorbing device 205 fails to properly absorb the liquid component from an ink image, thus a larger latent heat is required for water evaporation by the heat drying device 13, and the temperature of the ink image is not sufficiently increased. In this case, the liquid absorbing device 205 is subjected to maintenance or liquid removal conditions are changed.

Although $T_{_After}$ is used as the determination index of an image defect hereinbefore, a temperature before heat drying treatment $T_{_Before}$ is preferably used in combination to calculate $\Delta T$ represented by $T_{_After}-T_{_Before}$ because $\Delta T$ gives a more accurate determination result.

Next, an exemplary sequence of image defect detection/apparatus control of the ink jet recording apparatus in the example will be described with reference to FIG. 6.

When a sequence of image defect detection/apparatus control is started at step S1, detection pattern printing is performed at step S2. Here, a solid color pattern is printed by applying a Bk ink at 20 g/cm$^2$ as the detection pattern. As the detection pattern, a gradient pattern formed by changing the ink application amount or a color ink pattern formed by applying a Cyan ink, a Magenta ink, and a Yellow ink is also preferably used in combination.

Next, liquid absorption is performed at step S3. At step S4, the temperature before being subjected to heat drying treatment $T_{_Before}$ is detected by a temperature detecting device immediately before the heat drying treatment, and $T_{_Before}$ is recorded in an apparatus control unit. At step S5, the heat drying treatment is performed by a heat drying device, then at step S6, the temperature after heat drying treatment $T_{_After}$ is detected by a temperature detecting device, and $T_{_After}$ is recorded in the apparatus control unit. At step S7, $\Delta T_{_After}-T_{_Before}$ is calculated in the apparatus control unit. When $\Delta T_{min} \leq \Delta T$ is satisfied, Yes is selected, and the sequence proceeds to step S8 and is completed. $\Delta T_{_min}$ is the lower limit of a $\Delta T$-th range as the threshold for determination.

When No is selected, it is determined that the liquid absorbing unit 205 malfunctions (fails to work properly), and the sequence proceeds to step S7-1.

At step S7-1, a handling method for the malfunction of the liquid absorbing unit 205 is selected, or stop apparatus is selected.

Here, when the maintenance of a liquid absorbing device is selected, the sequence proceeds to step S7-1-1 to perform maintenance such as operation check and clogging check of the liquid absorbing device 205, and then the sequence returns to step S2 to perform detection pattern printing. When the operation condition change of a liquid absorbing device is selected, the sequence proceeds to step S7-1-2 to change conditions of the liquid absorbing unit, and then the sequence returns to step S2 to perform detection pattern printing.

Selectin of one of step S7-1-1 and S7-1-2 can be manual selection by a user or automatic selection by a previously set program. A mode of enabling selection of automatic selection or manual selection may be provided in an apparatus.

As a condition change of the liquid absorbing unit in the example, the liquid removal amount was increased, for example, by increasing the pressure of the pressing member 205*b* against ink images. When such a sequence is performed to finally arrive at step S8, a liquid can be stably removed from ink images, and ink images can be prevented from causing an image defect.

Figure 6:
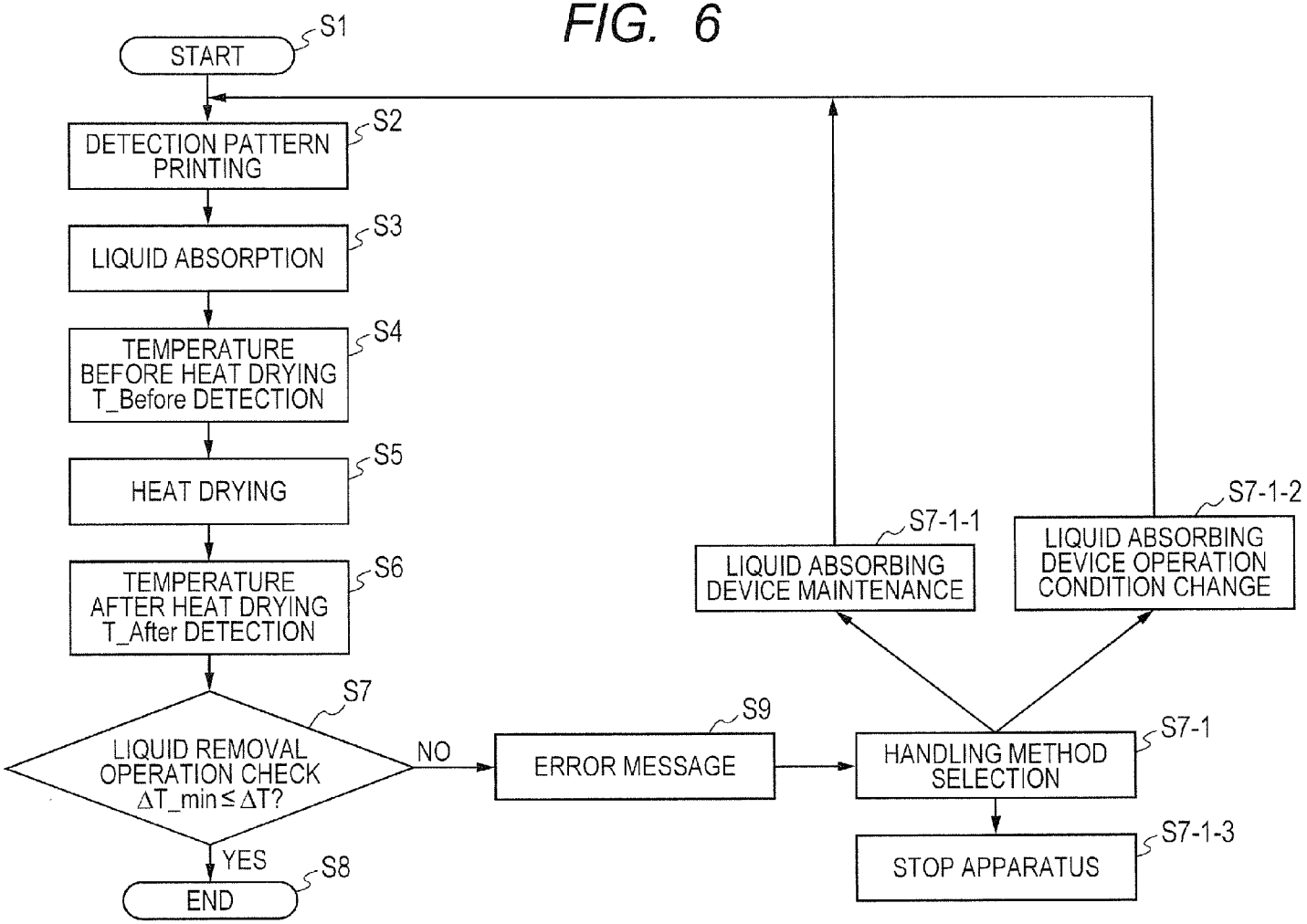
FIG. 6 is an exemplary sequence of image defect detection/apparatus control for the ink jet recording apparatus in Example 1 of the present invention.

As shown in FIG. 6, when the malfunction of the liquid absorption treatment device is determined at step S7, an error message (warning) can be displayed at step S9, and a handling method can be selected at step S7-1.

When both the handling methods are performed at S7-1-1 and S7-1-2 but the malfunction of the liquid absorbing device is not solved, the sequence can proceed to step S7-1-3 to perform the handling method of stopping the whole apparatus.

The timing of stopping the whole ink jet recording apparatus can be timing of ascertaining that the malfunction cannot be solved at S7-1-1 and S7-1-2. For example, when the error message is repeatedly displayed predetermined times, the apparatus can be stopped, and the liquid absorbing member can be replaced, for example.

Next, a temperature change of an ink image 32 before and after the drying treatment unit 13 will be specifically described in each case at step S7 in FIG. 6.

(A) when a Liquid Absorbing Device 205 Works Properly (in the Case of Yes at S7 in the Sequence)

Figure 7:
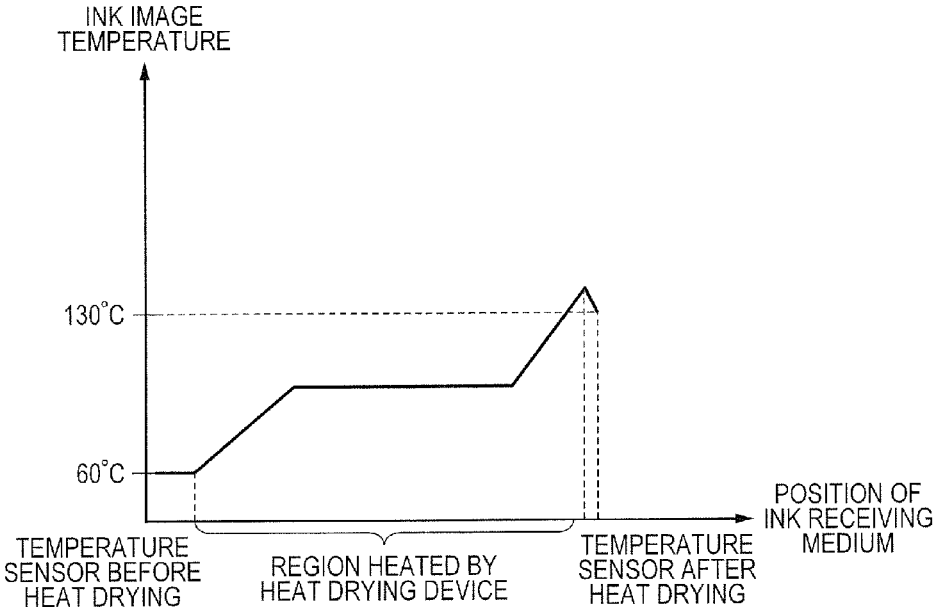
FIG. 7 is a graph showing a temperature change of an image when a contact type liquid absorbing device works properly in Example 1 of the present invention.

A temperature change of an ink image from step S4 to step S7 when a liquid absorbing device works properly at step S3 will be described with reference to FIG. 7 in detail.

In the example, the recording medium 208 was controlled at a temperature of 60° C., and thus at step S4, the temperature before heat drying treatment $T_{_Before}$ of the ink image was 60° C. Here, $T_{_Before}$=60° C. was recorded in an apparatus control unit. At step S5, the ink image was subjected to a heat drying treatment and was first heated to 100° C. as the critical temperature of water. The temperature of the ink image was maintained at 100° C. until substantially all the water evaporated. After the completion of the evaporation of water, the temperature of the ink image was further increased to a temperature slightly higher than 130° C. The heat drying treatment was completed, then the ink image arrived at the position of the temperature sensor 41 after heat drying treatment, and step S6 was performed. The temperature after heat drying treatment $T_{_After}$ of the ink image was measured to give $T_{_After}$=130° C. in the example and was recorded in the apparatus control unit. At step S7, $\Delta T=T_{_After}-T_{_Before}$ was calculated, giving ΔT=70° C. in the example. In the example, $\Delta T_{_min}$ was 65° C., thus Yes was selected at step S7, and the sequence was ended at step S8.

(B) When a Liquid Absorbing Device 205 Malfunctions (Fails to Work Properly) (in the Case of No at S7 in the Sequence)

Figure 8:
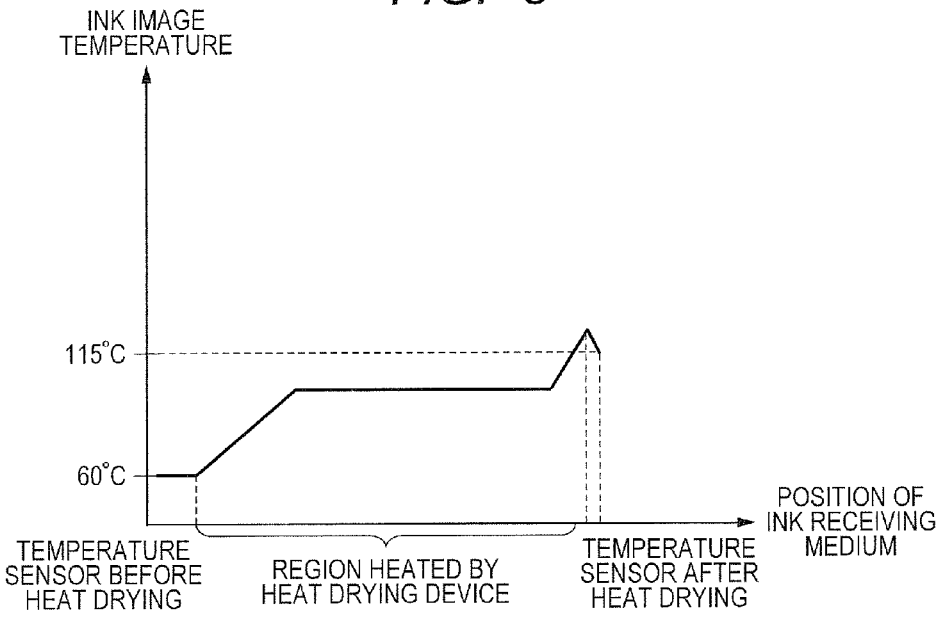
FIG. 8 is a graph showing a temperature change of an image when a contact type liquid absorbing device malfunctions in Example 1 of the present invention.

Next, a temperature change of an ink image from step S4 to step S7 when a liquid absorbing device fails to work properly at step S3 will be described with reference to FIG. 8 in detail.

In the example, the case in which a liquid absorbing device 205 does not work at all due to a device abnormality will be described.

The following sequence is the same as when the performance of a liquid absorbing device 205 partly degrades. As with the case when a liquid absorbing device 205 works properly, the $T_{_Before}$ value was 60° C. at step S4, and $T_{_Before}$=60° C. was recorded in the apparatus control unit. At step S5, the ink image was subjected to heat drying treatment and was first heated to 100° C. as the critical temperature of water. In this case, the liquid absorbing device 205 did not work at all, and thus it took a longer time for water evaporation as compared the case when the liquid absorbing device 205 worked properly. The passage speed of the ink image through the heat drying treatment region was the same, thus an increase in temperature of the ink image after the completion of water evaporation was small, and the temperature of the ink image was increased to only a temperature slightly higher than 115° C. At step S6, $T_{_After}$=115° C. was recorded in the apparatus control unit. At step S7, ΔT was calculated, and ΔT=55° C. was recorded. In the example, $\Delta T_{_min}$ was 65° C., and thus $\Delta T_{_min} \leq \Delta T$ was not satisfied. Hence, No is selected at step S7, and the sequence proceeds to step S7-1. At step S7-1, the sequence is selected to proceed to either step S7-1-1 (liquid absorbing device maintenance) or S7-1-2 (liquid absorbing device operation condition change).

In the example, S7-1-1 was selected to subject the liquid absorbing device to maintenance, then the sequence returned to step S2, and detection pattern printing was performed. A second sequence similarly proceeded to step S7, and ΔT was calculated to give ΔT=70° C. $\Delta T_{_min} \leq \Delta T$ was satisfied, and thus the sequence was ended at step S8. Here, two steps of $\Delta T_{_min}$, $\Delta T_{_min1}$ and $\Delta T_{_min2}$, are also preferably set at step S7 for the following automatic control. In the case of $\Delta T_{_min1} \leq \Delta T \leq \Delta T_{_min2}$, the abnormality of the liquid absorbing device 205 is slight, and thus the sequence proceeds step S7-1-2 (liquid absorbing device operation condition change). In the case of $\Delta T—\Delta T_{_min1}$, the abnormality of the liquid absorbing device 205 is severe, and thus the sequence proceeds to step S7-1-1 (liquid absorbing device maintenance).

By performing such an image defect detection/apparatus control sequence as above, the amount of liquid contained in an ink image can be controlled, and an ink jet recording apparatus capable of forming printed products having good abrasion resistance can be provided.

Example 2

Next, a second example of the ink jet recording method pertaining to the present invention will be specifically described with reference to drawings.

In the example, the transfer type ink jet recording apparatus that is shown in FIG. 1 and stably removes a liquid from ink images to enable the stable formation of printed products having good abrasion resistance was used.

In the example, a transfer body 101 is wound on a support member 102 and rotates clockwise around a rotating shaft 102*a* of the support member as the center. First, a reaction liquid applying device 103 applies a reaction liquid to the transfer body 101. In the same manner as in Example 1, an ink applying device 104 discharges an ink to form an ink image (first image) on the transfer body 101. When the ink image arrives at a liquid absorbing device 105, some of the liquid is absorbed from the ink image. When the ink image after the liquid absorption treatment (second image) arrives at a temperature detection position of a temperature sensor 40 before heat drying treatment, the temperature before heating $T_{_Before}$ of the ink image and the temperature before heating $T_P_{_Before}$ of a non-print region on the transfer body 101 are detected. The liquid component is further removed from the ink image by a heat drying device 13, and the temperature after heat drying treatment $T_{_After}$ of the ink image and the temperature after heating $T_P_{_After}$ of the non-print region on the transfer body 101 are detected by a temperature sensor 41 after heat drying treatment placed immediately after the heat drying device 13. When the ink image arrives at the position of a transfer unit 106, the ink image 32 is transferred to a recording medium 108 conveyed from a recording medium delivery roller 107*a* to a recording medium winding roller 107*b* in FIG. 1.

Next, an exemplary sequence of image defect detection/apparatus control of the ink jet recording apparatus in the example will be described with reference to FIG. 9.

When a sequence of image defect detection/apparatus control is started at step S1, detection pattern printing and contact type liquid removal are performed at step S2 and step S3, respectively, in the same manner as in Example 1.

At step S4, the temperature before heat drying treatment $T_{_Before}$ of the ink image 32 and the temperature before heat drying treatment $T_P_{_Before}$ of the non-print region on the transfer body 101 are detected, and $T_{_Before}$ and $T_P_{_Before}$ are recorded in an apparatus control unit 15.

Subsequently, a heat drying treatment is performed at step S5, then at step S6, the temperature after heat drying treatment $T_{_After}$ of the ink image and the temperature after heat drying treatment $T_P_{_After}$ of the non-print region on the transfer body 101 are detected, and $T_{_After}$ and $T_P_{_After}$ are recorded in the apparatus control unit 15.

At step S7, whether the heat drying device 13 works properly is determined. Whether the heat drying device 13 works properly is determined by whether the temperature after heat drying treatment $T_P_{_After}$ of the non-print region on the transfer body 101 is within a predetermined threshold (T_P-th) range. In other words, when the $T_P_{_After}$ is out of a predetermined value, it is determined that the output of the heat drying device 13 is excessively high or excessively low and that the heat drying device 13 malfunctions (fails to work properly). Whether ΔT_P represented by $T_P_{_After}-T_P_{_Before}$ is within a predetermined threshold (ΔT_P-th) range is more preferably determined because ΔT_P gives a more accurate result of the malfunction detection of the heat drying device.

In the example, $T_P_{_Before}$ was 60° C., $T_P_{_After}$ was 140° C., and thus ΔT_P was 80° C. In the example, $\Delta T_P_{_min}$ was 75° C., $\Delta T_P_{max}$ was 85° C., and thus Yes was selected at step S7. $\Delta T_P_{_min}$ is the lower limit of a ΔT_P-th range as the threshold for determination.

When ΔT_P is out of a predetermined threshold (ΔT_P-th) range, No is selected, and the sequence proceeds to step S7-1. The heat drying device 13 is subjected to maintenance or output control, and then detection pattern printing is performed again at step S2.

The malfunction detection of a liquid removing device and the malfunction detection of ink discharging at step S8 will be specifically described with reference to the figure showing a temperature change of an ink image 32.

(1) Malfunction of Ink Applying Device 104 (when (i) is Selected at Step S8)

Figure 10:
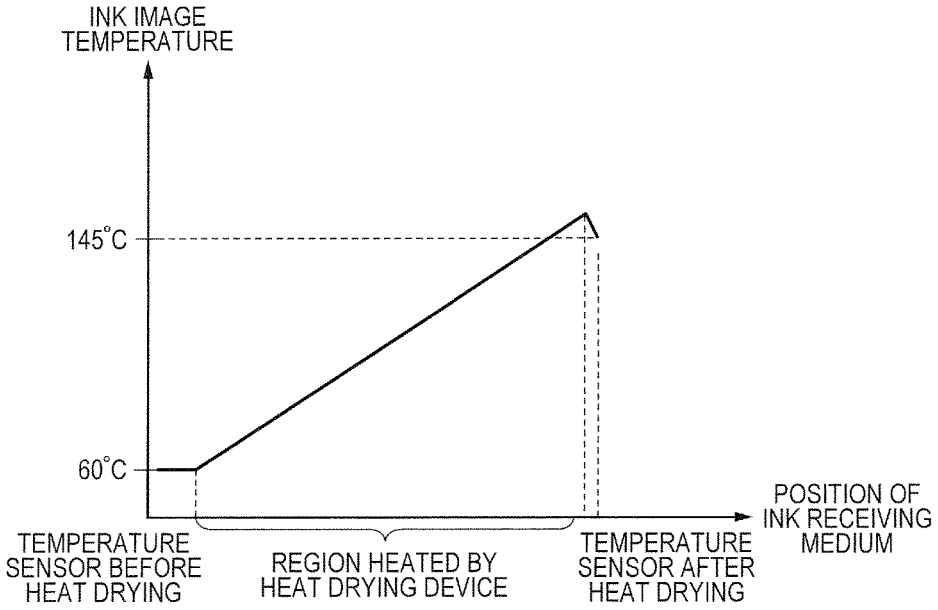
FIG. 10 is a graph showing a temperature change of an image when a discharge defect of the ink jet recording head causes an image defect in Example 2 of the present invention.

A temperature change of an image formation region on the transfer body 101 from step S4 to step S6 when no ink is discharged due to a fault of the ink applying device 104 will be described with reference to FIG. 10.

At step S4, the temperature $T_{_Before}$ of the image formation region was 60° C. Here, $T_{_Before}$=60° C. was recorded in an apparatus control unit. At step S5, the image formation region was subjected to a heat drying treatment by the heat drying device 13. The temperature of the image formation region was rapidly increased to a temperature slightly higher than 145° C. because no ink was discharged. When the image formation region arrived at the position of the temperature sensor 41 after heat drying treatment, step S6 was performed to record the temperature $T_{_After}$ of the image formation region. Here, $T_{_After}$=145° C. was recorded in the apparatus control unit. At step S7, $\Delta T=T_{_After}-T_{_Before}$ was calculated. In the example, ΔT was 85° C. In the example, $\Delta T_{_max}$ was 75° C., thus No was selected at step S7, and the sequence proceeded to step S7-1. $\Delta T_{_max}$ is the upper limit of a ΔT-th range as the threshold for determination.

Here, the maintenance of the ink applying device 104 and the operation check such as discharge check were performed at step S8-1, and the sequence returned to step S2 to perform detection pattern printing. A second sequence proceeded to step S8, and the conditions were determined, giving ΔT=70° C. and $\Delta T_{_min}$=55° C. $\Delta T_{min} \leq \Delta T \leq \Delta T_{_max}$ was thus satisfied, and the sequence proceeded to step S9 and was ended. $\Delta T_{_min}$ is the lower limit of a ΔT-th range as the threshold for determination.

(2) When a Liquid Absorbing Unit 205 Malfunctions (Fails to Work Properly) (when (ii) is Selected at Step S8)

In this case, a sequence proceeds to step S8-2, and a handling method for the malfunction of the liquid absorbing unit 205 is selected. Here, when the liquid absorbing device maintenance is selected, the sequence proceeds to step S8-2-1 to perform maintenance such as operation check and clogging check of the liquid absorbing device 205, and then the sequence returns to step S2. When the liquid absorbing device operation condition change is selected, the sequence proceeds to step S8-2-2 to change conditions of the liquid absorbing unit, for example, by increasing the pressure of the pressing member 205*b*, and then the sequence returns to step S2. These operations have been described in Example 1 and thus are not specifically described.

(3) When Both the Ink Applying Unit 104 and the Liquid Absorbing Device 205 Work Properly (when (iii) is Selected at Step S8)

In this case, the sequence proceeds straightly to step S9 and is ended.

When the apparatus control sequence described in the example is performed, the amount of liquid remaining in an ink image can be controlled while defects including a fault or insufficient output of the heat drying device 13 and malfunction of the ink applying device 104 are detected, and thus printed products having good abrasion resistance can be stably produced.

Figure 9:
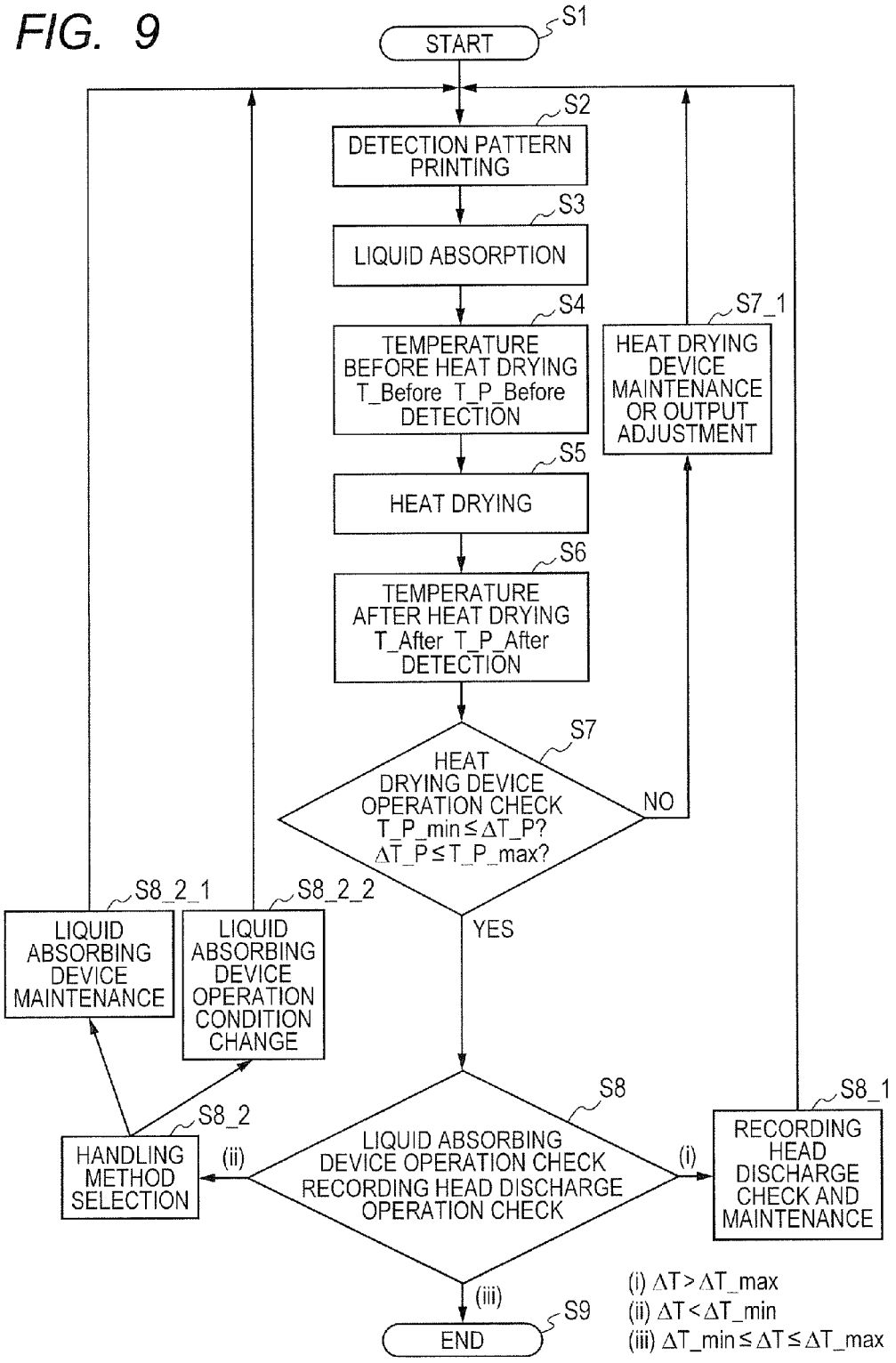
FIG. 9 is an exemplary sequence of image defect detection/apparatus control for the ink jet recording apparatus in Example 2 of the present invention.

The control by the sequence in FIG. 9 can also include a step of outputting an error message and a step of selecting stopping of the whole apparatus in the same manner as in FIG. 6.

In the present invention, the temperature of an image that has been subjected to a liquid absorption treatment and a heat drying treatment is used as the index for determining the working state of the liquid absorbing device that absorbs the liquid component from an image on the ink receiving medium, and the working state of the liquid absorbing device is determined on the basis of the temperature. According to the determination system, temperature measuring devices for measuring the temperature of an image are included in an ink jet recording apparatus, and the working state of the liquid absorbing device is determined by a determination unit on the basis of the measured temperatures. Hence, a highly reliable ink jet recording apparatus that prevents the occurrence of image defects can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-026428, filed Feb. 15, 2016, which is hereby incorporated by reference herein in its entirety.

What is claimed is:

1. An ink jet recording apparatus comprising:

an image forming unit configured to form a first image containing an aqueous liquid component and a coloring material on an ink receiving medium;

a liquid absorbing device including a porous body having a first surface configured to come into contact with the first image, the porous body being configured to absorb at least a part of the aqueous liquid component from the first image to form a second image;

a heat drying device configured to perform a heat drying treatment of the second image;

a first temperature measuring unit configured to measure a temperature $T_{_After}$ of the second image after being subjected to the heat drying treatment; and a determination unit configured to determine a working state of the liquid absorbing device from the temperature $T_{_After}$.

2. The ink jet recording apparatus according to claim 1, wherein the determination unit determines that the liquid absorbing device fails to work properly when the temperature $T_{_After}$ is outside a predetermined threshold temperature $T_{_After}$-th range.

3. The ink jet recording apparatus according to claim 2, wherein the temperature $T_{_After}$-th range is determined from an amount of liquid contained in the first image.

4. The ink jet recording apparatus according to claim 1, further comprising a second temperature measuring unit configured to measure a temperature $T_{_Before}$ of the second image before being subjected to the heat drying treatment, the determination unit determining that the liquid absorbing device fails to work properly when a difference between the temperature $T_{_After}$ and the temperature $T_{_Before}$ ($\Delta T$: $T_{_After}-T_{_Before}$) is outside a predetermined threshold temperature $\Delta T$-th range.

5. The ink jet recording apparatus according to claim 1, further comprising a control unit configured to direct the liquid absorbing device to be subjected to maintenance or to direct the liquid absorbing device to change a running condition of the liquid absorbing device when the determination unit determines that the liquid absorbing device fails to work properly.

6. The ink jet recording apparatus according to claim 5, wherein the change in the running condition of the liquid absorbing device includes a change in a pressure of the porous body of the liquid absorbing device against the first image.

7. The ink jet recording apparatus according to claim 1, further comprising a second temperature measuring unit configured to measure a temperature $T_P_{_After}$ of a non-image formation area of a region with the second image on the ink receiving medium after being subjected to the heat drying treatment, the determination unit including a mode of determining whether the heat drying device works properly based on the temperature $T_P_{_After}$.

8. The ink jet recording apparatus according to claim 7, wherein the determination unit determines that the heat drying device fails to work properly when the temperature $T_P_{_After}$ is outside a predetermined threshold temperature $T_P_{_After}$-th range.

9. The ink jet recording apparatus according to claim 7, further comprising a third temperature measuring unit configured to measure a temperature $T_P_{_Before}$ of the non-image formation area of the region with the second image on the ink receiving medium before the heat drying treatment, the determination unit determining that the heat drying device fails to work properly when a difference between the temperature $T_P_{_After}$ and the temperature $T_P_{_Before}$ ($\Delta T_P$: $T_P_{_After}-T_P_{_Before}$) is outside a predetermined threshold temperature $\Delta T_P$-th range.

10. The ink jet recording apparatus according to claim 7, further comprising a control unit configured to direct the heat drying device to be subjected to maintenance or to direct the heat drying device to change a running condition of the heat drying device when the determination unit determines that the heat drying device fails to work properly.

11. The ink jet recording apparatus according to claim 1, further comprising a control unit configured to direct the image forming unit to be subjected to maintenance or to direct the image forming unit to check an ink applying state to the ink receiving medium when the determination unit determines that the liquid absorbing device fails to work properly.

12. The ink jet recording apparatus according to claim 1, wherein the first temperature measuring unit includes a noncontact type temperature measuring member.

13. The ink jet recording apparatus according to claim 1, wherein the image forming unit includes a liquid applying unit configured to apply a liquid to the ink receiving medium, and the liquid improves a fixability of the ink to the ink receiving medium.

14. The ink jet recording apparatus according to claim 1, wherein the ink receiving medium is a transfer body configured to temporarily hold the first image and the second image, and the second image is transferred to a recording medium on which a final image is to be formed.

15. The ink jet recording apparatus according to claim 1, wherein the ink receiving medium is a recording medium on which a final image is to be formed, and the first image is formed on the recording medium.

16. An ink jet recording apparatus comprising:

an image forming unit configured to form an ink image containing an aqueous liquid component and a coloring material on an ink receiving medium;

a liquid absorbing device including a porous body configured to perform a liquid absorption treatment to concentrate the ink image, the porous body being configured to come into contact with the ink image to absorb at least a part of the aqueous liquid component from the ink image;

a heat drying device configured to perform a heat drying treatment of the ink image after the liquid absorption treatment;

a temperature measuring unit configured to measure a temperature $T_{_After}$ of the ink image after being subjected to the heat drying treatment; and a determination unit configured to determine a working state of the liquid absorbing device from the temperature $T_{_After}$.

* * * * *